US009702186B2

(12) United States Patent
Colson

(10) Patent No.: US 9,702,186 B2
(45) **Date of Patent: *Jul. 11, 2017**

(54) SINGLE-TRACK STACKING PANEL COVERING FOR AN ARCHITECTURAL OPENING

(71) Applicant: Hunter Douglas, Inc., Pearl River, NY (US)

(72) Inventor: Wendell B. Colson, Weston, MA (US)

(73) Assignee: Hunter Douglas Inc., Upper Saddle River, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/814,967

(22) Filed: Jul. 31, 2015

(65) Prior Publication Data

US 2016/0024840 A1 Jan. 28, 2016

Related U.S. Application Data

(60) Continuation of application No. 13/567,843, filed on Aug. 6, 2012, now abandoned, which is a division of (Continued)

(51) Int. Cl.

| | |
|---|---|
| ***E06B 9/36*** | (2006.01) |
| ***E06B 3/92*** | (2006.01) |
| ***E06B 9/06*** | (2006.01) |
| ***E06B 9/262*** | (2006.01) |
| ***E06B 9/386*** | (2006.01) |

(Continued)

(52) U.S. Cl.

CPC ..... *E06B 9/365* (2013.01); *E06B 3/924* (2013.01); *E06B 9/0638* (2013.01); *E06B 9/0676* (2013.01); *E06B 9/262* (2013.01); *E06B 9/36* (2013.01); *E06B 9/386* (2013.01);

(Continued)

(58) Field of Classification Search

CPC ..... E06B 3/925; E06B 9/0638; E06B 9/367

USPC ..... 160/197, 202, 223, 168.1 V, 237, 173 V, 160/178.1 V

See application file for complete search history.

(56) References Cited

U.S. PATENT DOCUMENTS 1,468,433 A * 9/1923 Zackow ..... E06B 9/36 16/87.8

1,962,868 A 6/1934 Gregg (Continued)

FOREIGN PATENT DOCUMENTS

| | | |
|---|---|---|
| CN | 2634076 | 8/2004 |
| CN | 2703855 Y | 6/2005 |

(Continued)

*Primary Examiner* — David Purol

(74) *Attorney, Agent, or Firm* — Dority & Manning, P.A.

(57) ABSTRACT

A stacking panel covering for an architectural opening includes a headrail and a plurality of suspended from the headrail. The panels form an overlapped stack at one end of the headrail when the stacking panel covering is opened, and cover the architectural opening when the stacking panel covering is closed. The panels are piggybacked on those adjacent thereto, so that they stack, one behind the next, when the stacking panel covering is opened, and so that each pulls the next adjacent thereto as the stacking panel covering is being closed. The panels themselves may be planar, or convexly curved in a horizontal direction and substantially straight in a vertical direction.

22 Claims, 27 Drawing Sheets

Related U.S. Application Data application No. 11/883,951, filed as application No. PCT/US2006/008552 on Mar. 9, 2006, now Pat. No. 8,256,490.

(60) Provisional application No. 60/662,241, filed on Mar. 16, 2005.

(51) Int. Cl.
*E06B 9/388* (2006.01)
*A47H 23/02* (2006.01)

(52) U.S. Cl.
CPC ..... *E06B 9/388* (2013.01); *A47H 2023/025* (2013.01); *E06B 2009/2622* (2013.01)

(56) References Cited

U.S. PATENT DOCUMENTS

| | | | | |
|---|---|---|---|---|
| 2,012,887 | A | 8/1935 | Major | |
| 2,024,090 | A | 12/1935 | Cadmus | |
| 2,200,605 | A | 5/1940 | Pierce | |
| 2,231,778 | A | 2/1941 | Swanson | |
| 2,267,869 | A | 12/1941 | Loehr | |
| 3,298,425 | A * | 1/1967 | Cayton | E06B 9/367 160/176.1 V |
| 3,348,603 | A | 10/1967 | Ford | |
| 3,467,037 | A | 9/1969 | Frydryk | |
| 3,599,704 | A * | 8/1971 | Woodle | E06B 9/367 160/173 R |
| 3,750,737 | A | 8/1973 | Woodward | |
| 3,911,991 | A | 10/1975 | Malferrari | |
| 3,990,201 | A | 11/1976 | Falbel | |
| 4,039,019 | A | 8/1977 | Hopper | |
| 4,066,062 | A | 1/1978 | Houston | |
| 4,078,323 | A | 3/1978 | Baumgarten | |
| 4,194,550 | A | 3/1980 | Hopper | |
| 4,221,255 | A | 9/1980 | Barkemeyer | |
| 4,291,738 | A * | 9/1981 | Grenga | E06B 9/367 160/172 R |
| 4,338,996 | A | 7/1982 | Frank | |
| 4,359,079 | A | 11/1982 | Bledsoe | |
| 4,382,436 | A | 5/1983 | Hager | |
| 4,532,917 | A | 8/1985 | Taff et al. | |
| 4,535,828 | A | 8/1985 | Brockhaus | |
| 4,550,758 | A | 11/1985 | Johnson et al. | |
| 4,649,980 | A | 3/1987 | Kunz | |
| 4,692,744 | A | 9/1987 | Hickman | |
| 4,722,382 | A | 2/1988 | Vecchiarelli | |
| 4,763,890 | A | 8/1988 | Zimmerman et al. | |
| 4,998,577 | A | 3/1991 | Kobayashi et al. | |
| 5,109,910 | A | 5/1992 | Tortorella et al. | |
| 5,129,440 | A | 7/1992 | Colson | |
| 5,217,000 | A | 6/1993 | Pierce-Bjorklund | |
| 5,325,579 | A | 7/1994 | Baier | |
| D352,856 | S | 11/1994 | Ford | |
| 5,503,210 | A | 4/1996 | Colson et al. | |
| 5,547,006 | A | 8/1996 | Auger | |
| 5,566,738 | A | 10/1996 | Yadidya | |
| 5,600,974 | A | 2/1997 | Schnegg et al. | |
| 5,608,995 | A | 3/1997 | Borden | |
| 5,638,881 | A | 6/1997 | Ruggles et al. | |
| 5,712,332 | A | 1/1998 | Kaieda et al. | |
| 5,832,980 | A | 11/1998 | Cianciolo | |
| 6,057,029 | A | 5/2000 | Demestre et al. | |
| 6,094,290 | A | 7/2000 | Crawford et al. | |
| D439,785 | S | 4/2001 | Throne | |
| D440,102 | S | 4/2001 | Colson et al. | |
| D444,658 | S | 7/2001 | Swiszcz et al. | |
| 6,257,302 | B1 | 7/2001 | Bednarczyk et al. | |
| D446,416 | S | 8/2001 | Throne | |
| 6,302,982 | B1 | 10/2001 | Corey et al. | |
| 6,345,476 | B1 | 2/2002 | Hill | |
| 6,374,896 | B1 | 4/2002 | Møller | |
| D459,933 | S | 7/2002 | Goodman | |
| 6,470,950 | B2 | 10/2002 | Shimizu | |
| 6,484,390 | B1 | 11/2002 | Gouldson et al. | |
| 6,613,404 | B2 | 9/2003 | Johnson | |
| 6,688,369 | B2 | 2/2004 | Colson et al. | |
| 6,745,811 | B1 | 6/2004 | Nien | |
| 6,758,211 | B1 | 7/2004 | Schmidt | |
| D496,204 | S | 9/2004 | Tuzmen | |
| 6,792,994 | B2 | 9/2004 | Lin | |
| D498,105 | S | 11/2004 | Tyner | |
| D503,578 | S | 4/2005 | Boehm | |
| 6,892,783 | B1 | 5/2005 | Comeau et al. | |
| 7,058,292 | B2 | 6/2006 | Hirano | |
| 7,063,122 | B2 | 6/2006 | Colson et al. | |
| 7,100,666 | B2 | 9/2006 | Colson et al. | |
| 7,111,659 | B2 | 9/2006 | Harper et al. | |
| 7,409,980 | B1 | 8/2008 | Heissenberg | |
| 7,417,397 | B2 | 8/2008 | Berman et al. | |
| 7,418,313 | B2 | 8/2008 | Devis et al. | |
| 7,513,292 | B2 | 4/2009 | Auger et al. | |
| 7,549,455 | B2 | 6/2009 | Harper et al. | |
| 7,588,068 | B2 | 9/2009 | Colson et al. | |
| 7,637,301 | B2 | 12/2009 | Forst Randle | |
| 7,708,047 | B2 | 5/2010 | Auger | |
| D632,493 | S | 2/2011 | Colson et al. | |
| D640,472 | S | 6/2011 | Colson et al. | |
| 7,971,624 | B2 | 7/2011 | Harper et al. | |
| D646,516 | S | 10/2011 | Ehrsam | |
| D657,176 | S | 4/2012 | Stern | |
| 8,171,640 | B2 | 5/2012 | Colson et al. | |
| 8,256,490 | B2 | 9/2012 | Colson | |
| D668,090 | S | 10/2012 | Colson et al. | |
| D671,349 | S | 11/2012 | Judkins | |
| 8,405,901 | B2 | 3/2013 | Boote | |
| 8,496,768 | B2 | 7/2013 | Holt et al. | |
| D691,397 | S | 10/2013 | Colson et al. | |
| D692,684 | S | 11/2013 | Colson et al. | |
| 8,587,242 | B2 | 11/2013 | Berman et al. | |
| 8,639,387 | B2 | 1/2014 | Byberg et al. | |
| 8,763,673 | B2 | 7/2014 | Jelic et al. | |
| 8,827,347 | B2 | 9/2014 | Snider | |
| 9,081,171 | B2 | 7/2015 | Dean et al. | |
| 9,130,097 | B2 | 9/2015 | Taheri et al. | |
| 2006/0179991 | A1 | 8/2006 | Nien et al. | |
| 2006/0247377 | A1 | 11/2006 | Riegel et al. | |
| 2007/0074826 | A1 | 4/2007 | Jelic et al. | |
| 2007/0088104 | A1 | 4/2007 | Hung et al. | |
| 2008/0014446 | A1 | 1/2008 | Donea et al. | |
| 2008/0303686 | A1 | 12/2008 | Mosbrucker | |
| 2009/0205789 | A1 | 8/2009 | Watkins et al. | |
| 2010/0126675 | A1 | 5/2010 | Jelic et al. | |
| 2010/0266801 | A1 | 10/2010 | Jahoda et al. | |
| 2010/0276089 | A1 | 11/2010 | Jelic et al. | |
| 2011/0088324 | A1 | 4/2011 | Wessel | |
| 2011/0133940 | A1 | 6/2011 | Margalit | |
| 2012/0118514 | A1 | 5/2012 | Hughes | |
| 2012/0222722 | A1 | 9/2012 | Baruchi et al. | |
| 2012/0241104 | A1 | 9/2012 | Huffer et al. | |
| 2012/0318475 | A1 | 12/2012 | Glover | |
| 2013/0098565 | A1 | 4/2013 | Colson et al. | |
| 2013/0105094 | A1 | 5/2013 | Colson et al. | |
| 2014/0034251 | A1 | 2/2014 | Colson et al. | |
| 2014/0053989 | A1 | 2/2014 | Colson et al. | |

FOREIGN PATENT DOCUMENTS

| | | | |
|---|---|---|---|
| CN | 1918356 | A | 2/2007 |
| CN | 101455856 | | 6/2009 |
| DE | 70451 | C | 8/1893 |
| DE | 2709207 | A1 | 9/1978 |
| DE | 3912528 | A1 | 10/1990 |
| EP | 0511956 | A1 | 11/1992 |
| EP | 2113626 | A2 | 11/2009 |
| EP | 2154326 | A1 | 2/2010 |
| GB | 1494842 | | 12/1977 |
| JP | S 54117865 | | 9/1979 |
| JP | S 5949449 | | 3/1984 |
| JP | 2004176966 | | 6/2004 |
| JP | 2009148455 | | 7/2009 |
| WO | WO 97/04207 | | 2/1997 |
| WO | WO 02/06619 | A1 | 1/2002 |

(56) References Cited

FOREIGN PATENT DOCUMENTS

| | | | |
|---|---|---|---|
| WO | WO 02/41740 | A1 | 5/2002 |
| WO | WO 2005/062875 | A2 | 7/2005 |
| WO | WO 2005/098190 | A1 | 10/2005 |
| WO | WO 2010/059581 | A2 | 5/2010 |
| WO | WO 2011/130593 | A2 | 10/2011 |
| WO | WO 2012/142519 | A1 | 10/2012 |
| WO | WO 2012/142522 | A1 | 10/2012 |

* cited by examiner

SINGLE-TRACK STACKING PANEL COVERING FOR AN ARCHITECTURAL OPENING

CROSS-REFERENCE TO RELATED APPLICATIONS

This patent application is a continuation of and claims the benefit of priority to U.S. patent application Ser. No. 13/567,843, filed Aug. 6, 2012, which in turn is a division of and claims the benefit of priority to U.S. patent application Ser. No. 11/883,951, filed Aug. 3, 2009, which in turn is a U.S. National Stage of International Application No. PCT/US2006/008552, filed Mar. 9, 2006, which in turn claims the benefit of priority to U.S. Patent Application Ser. No. 60/662,241, filed Mar. 16, 2005. Each of the foregoing patent applications is hereby incorporated by reference herein in its entirety for all purposes.

BACKGROUND

Field of the Invention

The present invention relates to vertically hanging paneled coverings for architectural openings, such as doors and windows, particularly where the latter extend substantially from the floor to the ceiling. More specifically, the present invention relates to coverings of this variety where, when opened, the individual panels making up the covering form a vertically hanging stack on one of the two sides of the opening, and, when closed, the individual panels cannot be rotated about their vertical axes.

Description of the Relevant Art

There are at least several examples of coverings of this general type in the relevant U.S. patent art.

U.S. Pat. No. 3,260,303 to Pipe shows a multi-panel sliding door having a plurality of vertically supported panels interconnected by a system of structural elements which provide a simultaneous progressive sliding motion of the panels in moving one panel behind another when the structure is opened from either end.

U.S. Pat. No. 3,342,245 to Caillet shows a retractable cover for closing horizontal or substantially horizontal openings, such as hatchways on ships. The cover comprises a plurality of interconnected panels which are stacked one atop the next at the free end of the cover as it is opened. When closed, the cover is capable of supporting heavy loads.

U.S. Pat. No. 3,348,603 to Ford shows a movable panel assembly comprising elongated overhead track means having a plurality of lengthwise extending, laterally spaced, externally opening passageways therein. Elongated carriers extend into the passageways and are supported thereon for lengthwise movement along the track means. The carriers each, have an externally extending wall portion which presents a mounting surface on which a panel can be mounted, whereby the panels are mounted on the carriers for lengthwise movement therewith. The panels are normally of a width equal to the length of the mounting surface and preferably have substantial stiffness so that they can be supported upon the carriers without sagging or folding. The panels are each supported on the respective carriers so that they are flat and unpleated whereby they create an effect similar to that of a hanging tapestry. Stop means are provided for positioning and preventing movement of the carriers in one direction past each other at one end of the track whereby the carriers can be positioned in a fully overlapping, aligned relation in which only the forwardmost one of the panels is exposed to view.

U.S. Pat. No. 3,574,887 to Schindlauer shows a curtain holder having running slots for gliders. The holder incorporates a face panel for hiding the upper portion of the curtains and gliders. The face panel is removably attached to the holder by a snap-joint fit. The face panel can also be applied to the ends of the holder, and friction insert means are used to assist in attaching the ends of the face panel to the holder.

U.S. Pat. No. 3,911,991 to Malferrari shows a curtain comprising a stationary supporting device, formed by a plurality of modular elements and by two end pieces, and provided with longitudinal guiding channels or runways with a longitudinal lower slot. The curtain also has a plurality of box-like elongated members, slidingly mounted in some of the longitudinal runways, and of a plurality of panels each formed of a length of cloth or other flexible laminar material and carried by one of the box-like members. The end pieces of the stationary supporting device are adapted to telescopically receive for the desired extent the facing end of the stationary supporting device, while each box-like member supports the pertinent panel by means of a first composite bar adapted to lock, in releasable manner, the upper edge of the cloth length thereto. The lower portion of the cloth length that exceeds the useful cloth is rolled up and accommodated in the inside of a second composite bar, having means to enable a relative movement between two adjacent panels to pass from an overlapping relationship to a substantially aligned relationship and to be then moved in unison as train elements drawn by a pilot panel with the vertical edges of two adjacent panels overlapping one another for a desired adjustable extent.

U.S. Pat. No. 4,221,255 to Barkemeyer shows a decorative panel assembly having a valance board which receives and maintains a plurality of tracks. The tracks receive rollers connected to decorative panels. The panels and valance board are provided with edge clamps which act as moldings or are used for securing decorative coverings thereto. A first source of illumination is provided in the valance board and in front of the panels to cast light upon the same. A second light source is vertically positioned behind the end panels for creating an indirect lighting or ghosting effect. A spring-biased curtain rod holder may be maintained within the valance board and behind the panels, if so desired.

U.S. Pat. No. 5,109,910 to Tortorella et al. shows a vertical curtain panel assembly for covering windows, sliding glass doors and the like with a plurality of large, wide, highly decorative panels. The panel assembly includes a plurality of interconnectable frame units having a plurality of channels with movable carriers positioned therein, and disposed such that by utilizing a single draw string attached to a single carrier, the plurality of carriers having decorative panels extending therefrom, may be readily moved between an opened position, wherein all the panels are concealed behind an outermost fixed panel, and a closed window-covering position, wherein each panel is exposed and covers a designated area.

SUMMARY OF THE DISCLOSURE

The present disclosure relates to a single-track stacking panel covering for an architectural opening. The stacking panel covering includes a headrail which may be mounted above and in front of an architectural opening, such as a door or window, particularly a transparent sliding door or floor-to-ceiling window. The headrail can have a first end and a second end at the extreme left and right thereof and a longitudinal direction between the first and second ends. The headrail may be perfectly straight or linear, or may have one or more curved portions between the first and second ends.

A plurality of panels can be suspended from the headrail. Each panel may be planar or convexly curved in a horizontal direction and substantially straight in a vertical direction. Each of the panels can have a first upper corner and a second upper corner at the extreme upper left and right thereof.

The first upper corner of the panel closest to the first end of the headrail can be slidably attached to the headrail, while the first upper corners of the remainder of the panels can be slidably attached to an adjacent panel closer to the first end of the headrail, thereby linking the panels together.

The second upper corner of each of the panels can be attached to the headrail, that for the panel closest to the second end of the headrail being fixed at the second end of the headrail, while those for the remainder of the panels can be slidable back and forth in the longitudinal direction of the headrail.

The plurality of panels can form an overlapped stack at the second end of the headrail when the panel closest to the first end of the headrail is directed toward the second end to open the stacking panel covering, each panel slipping behind that adjacent thereto during the opening operation. The reverse can occur when the panel closest to the first end of the headrail is directed toward the first end of the headrail to close the stacking panel covering.

An alternate embodiment of the single-track stacking panel covering also includes a headrail which can be mounted above and in front of an architectural opening. The headrail can have a first end and a second end at the extreme left and right thereof and a longitudinal direction between the first and second ends. The headrail can be perfectly straight or linear, if desired.

The stacking panel covering of the alternate embodiment also can include a headrail portion at the first end of the headrail. The headrail portion may be substantially perpendicular to the headrail.

A plurality of panels can be suspended from the headrail. Each panel can be planar or convexly curved in a horizontal direction and substantially straight in a vertical direction. Each of the panels can have a first upper corner and a second upper corner at the extreme upper left and right thereof.

The first upper corner of the panel closest to the first end of the handrail can be slidably attached to the headrail portion, while the first upper corners of the remainder of the panels can be slidably attached to an adjacent panel closer to the first end of the headrail, thereby linking the panels together.

The second upper corner of each of the panels can be attached to the headrail and can be slidable back and forth in the longitudinal direction of the headrail.

The plurality of panels can form an overlapped stack at the first end of the headrail when the panels are directed toward the first end to open the stacking panel covering, each panel slipping in front of that adjacent thereto during the opening operation. The reverse can occur when the panel closest to the second end of the headrail is moved toward the second end of the headrail to close the stacking panel covering.

The present single-track stacking panel covering will now be described in more complete detail with frequent reference being made to the figures identified below.

DETAILED DESCRIPTION OF THE PREFERRED EMBODIMENTS

Figure 1:
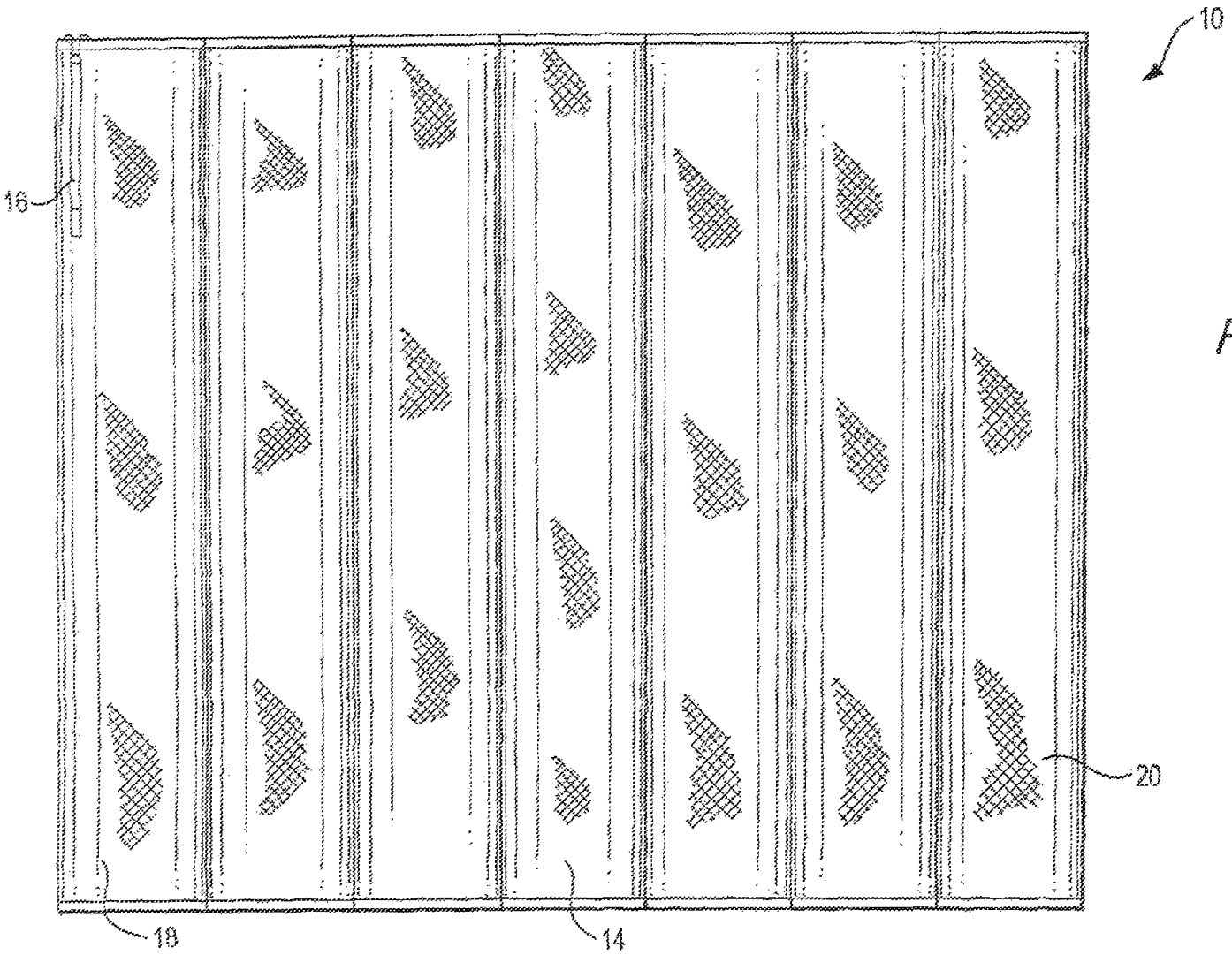
FIG. 1 is a plan view of an exemplary stacking panel covering of the present disclosure when closed.
Figure 2:
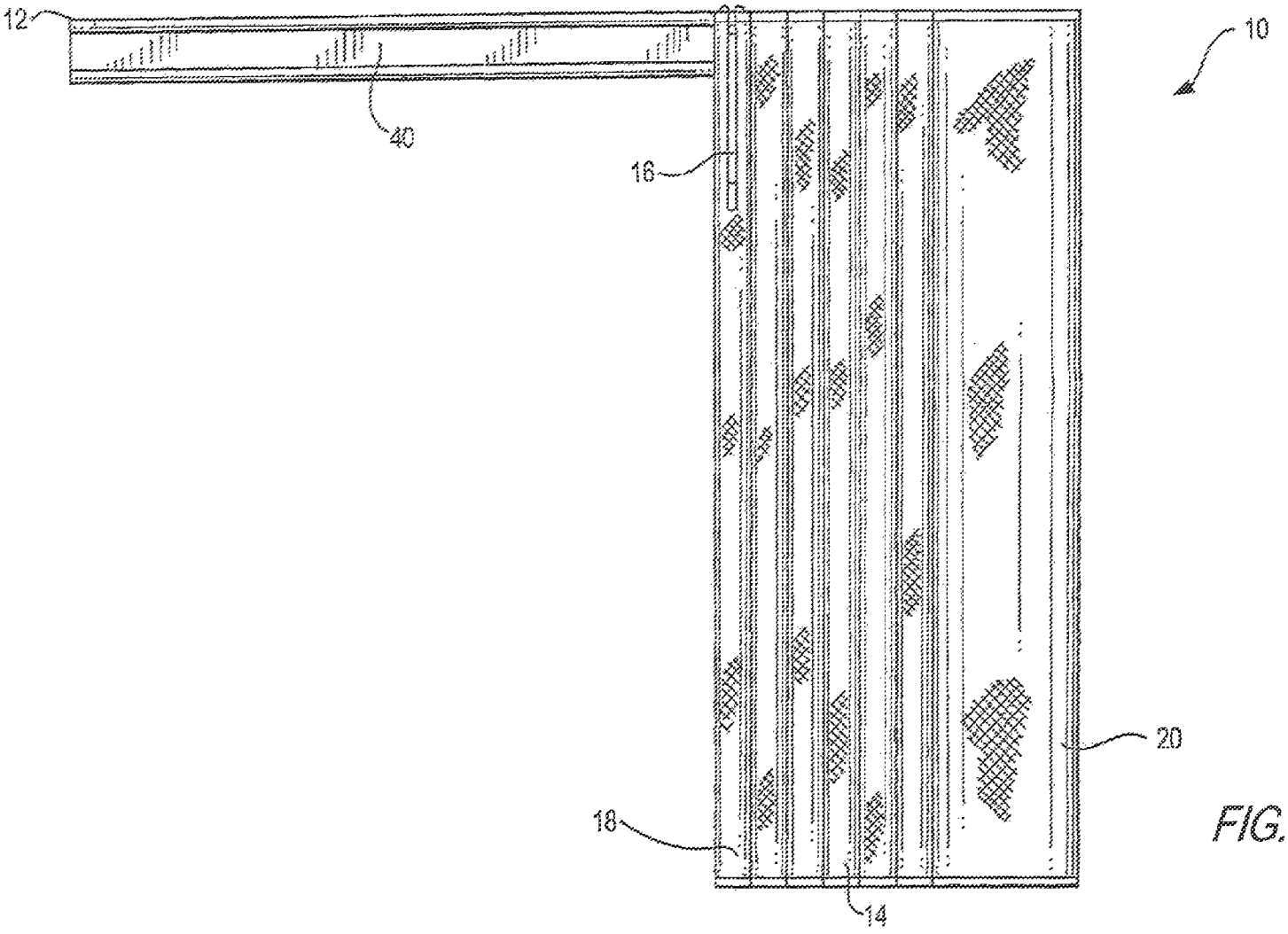
FIG. 2 is a plan view of the illustrative stacking panel covering when fully opened.

Turning now more particularly to these figures, FIGS. 1 and 2 are plan views of an exemplary stacking panel covering of the present disclosure when closed and opened, respectively. The stacking panel covering 10 includes a headrail 12, which can typically be mounted across the top of a window, sliding door or other architectural opening. The stacking panel covering 10 may extend from the top of the opening to below its bottom, or to a convenient distance above the bottom, as dictated by the nature of the opening.

The stacking panel covering 10 can include a plurality of individual panels 14, which may be planar or curved, and can be suspended and hang below the headrail 12 by means to be described below. By virtue of those means, the panels 14 may be curved to the extent that they are cylindrically convex when viewed from the interior of a room in which the stacking panel covering 10 is hung. That is to say, they may be curved or arcuate in a crosswise or horizontal direction, but are generally straight in a vertical direction.

The panels 14 themselves may be made of woven fabric of any of the materials and styles used in the manufacture of window shades and blinds. Alternatively, the panels 14 may be made of metal sheet material, such as aluminum sheet, which may be perforated to some desired degree, or of plastic sheet, which may also be perforated. As for the plastic sheet, all colors and degrees of transparency thereof may be used to provide plastic sheet for panels 14.

It will be noted in FIGS. 1 and 2 that the stacking panel covering 10 can include seven panels 14. It should be understood that fewer or more panels 14 could be used to manufacture a stacking panel covering 10 according to the present invention, and that there is no intention on the part of the inventors to limit the number of panels 14 to be seven. Moreover, the panels 14 may be either narrower or wider than may be suggested in FIGS. 1 and 2.

A rod is attached to the component, to be described more completely below, from which the leftmost panel 18 is suspended, to enable the stacking panel covering 10 to be opened or closed. As illustrated in FIGS. 1 and 2, the stacking panel covering 10 is opened by pulling rod 16 to the right. This action pulls leftmost panel 18 behind the panel 14 to its immediate right, and, in turn, each subsequent panel 14 behind that to its immediate right until the stacking panel covering 10 assumes the open condition shown in FIG. 2. When fully opened, panels 14, 18 are overlappingly stacked with each panel 14, 18 extending outwardly from behind that in front of it in the stack by an amount, which will be referred to as the stacking distance. The latter may be 1.0 inch, 2.0 inches or some other selected amount, as desired, and is set by components of the stacking panel covering 10 to be described below. Clearly, FIGS. 1 and 2 are not drawn to scale, as should now be apparent to the reader.

When the stacking panel covering 10 is to be closed by pulling rod 16 to the left in FIG. 2 to eventually restore the stacking panel covering 10 to the closed condition shown in FIG. 1, leftmost panel 18 is pulled out from behind the panel 14 to its immediate right to a point where it begins to pull that panel 14 to the right. Continued pulling on rod 16 pulls each subsequent panel 14 out from behind that to its immediate right until the stacking panel covering 10 assumes the closed condition shown in FIG. 1. When the stacking panel covering 10 is completely closed, each panel 14, 18 overlaps that to its left by a small amount, perhaps 1.0 inch, so that the architectural opening, in front of which the stacking panel covering 10 is disposed, is completely blocked when viewed from directly in front of the stacking panel covering 10.

In FIGS. 1 and 2, stacking panel covering 10 is opened and closed using rod 16 at the extreme left. Rightmost panel 20 is essentially in a fixed position, with the remaining panels 14, 18 sliding partly behind rightmost panel 20 when the stacking panel covering 10 is being opened and sliding out from behind rightmost panel 20 when the stacking panel covering 10 is being closed. It is to be understood, and is within the scope of the present invention, that, alternatively, leftmost panel 18 may be fixed instead of rightmost panel 20 and that the stacking panel covering 10 may be opened and closed using a rod 16 mounted at the extreme right of rightmost panel 20. In such an alternative, the opened stacking panel covering 10 would have its overlappingly stacked panels 14, 18, 20 disposed on the left side of FIG. 2 as each panel 14, 20 would slide behind that to its immediate left as the stacking panel covering 10 is being opened. In other words, such a stacking panel covering 10 would be the mirror image of that shown in FIGS. 1 and 2.

While the stacking panel covering 10 has been described to this point as being opened and closed by means of rod 16, it should be understood that there is no intention on the part of the inventors to limit the present invention in this respect. Numerous other approaches, motorized or manual, may be taken to open and close the present stacking panel covering 10, and all are considered to fall within the scope of the present invention. Moreover, panels 14, 18, 20 may be linked together using a pantograph so that all of the movable panels 14, 18, 20 in a given stacking panel covering 10 may move smoothly in unison when the stacking panel covering 10 is being opened or closed.

Figure 3:
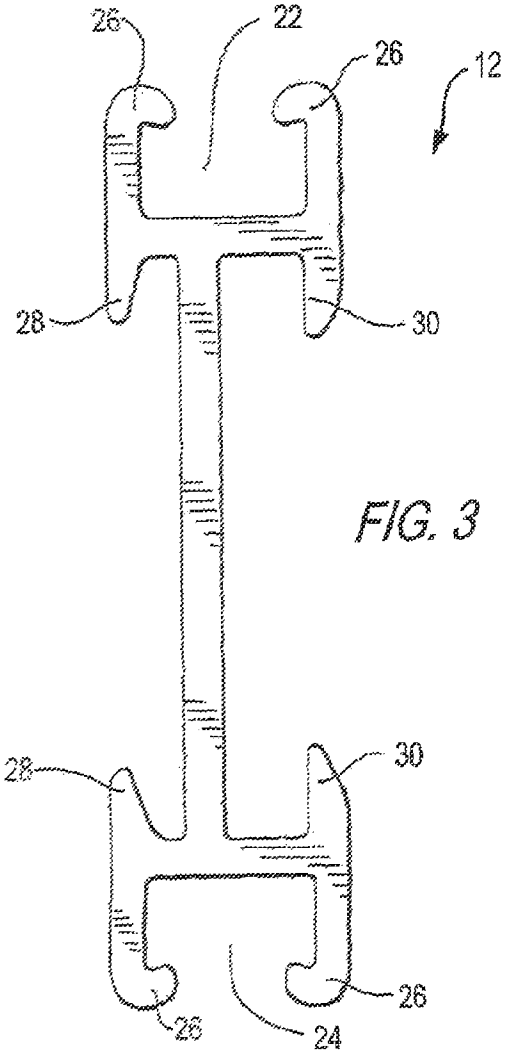
FIG. 3 is a cross-sectional view of the headrail of the stacking panel covering.

Turning our attention now to the headrail 12, it will be observed that the headrail 12 is visible when the stacking panel covering 10 is open, but completely hidden when it is closed. A cross-sectional view of the headrail 12 is shown in FIG. 3. Headrail 12 may be extruded from aluminum or plastic, and includes an upper U-shaped channel 22 and a lower U-shaped channel 24, each having inwardly directed members 26 at the entrance thereof. Both sides of the headrail 12 have prongs, prongs 28 on the rear and prongs 30 on the front, whose purpose will be made clear below.

Figure 4:
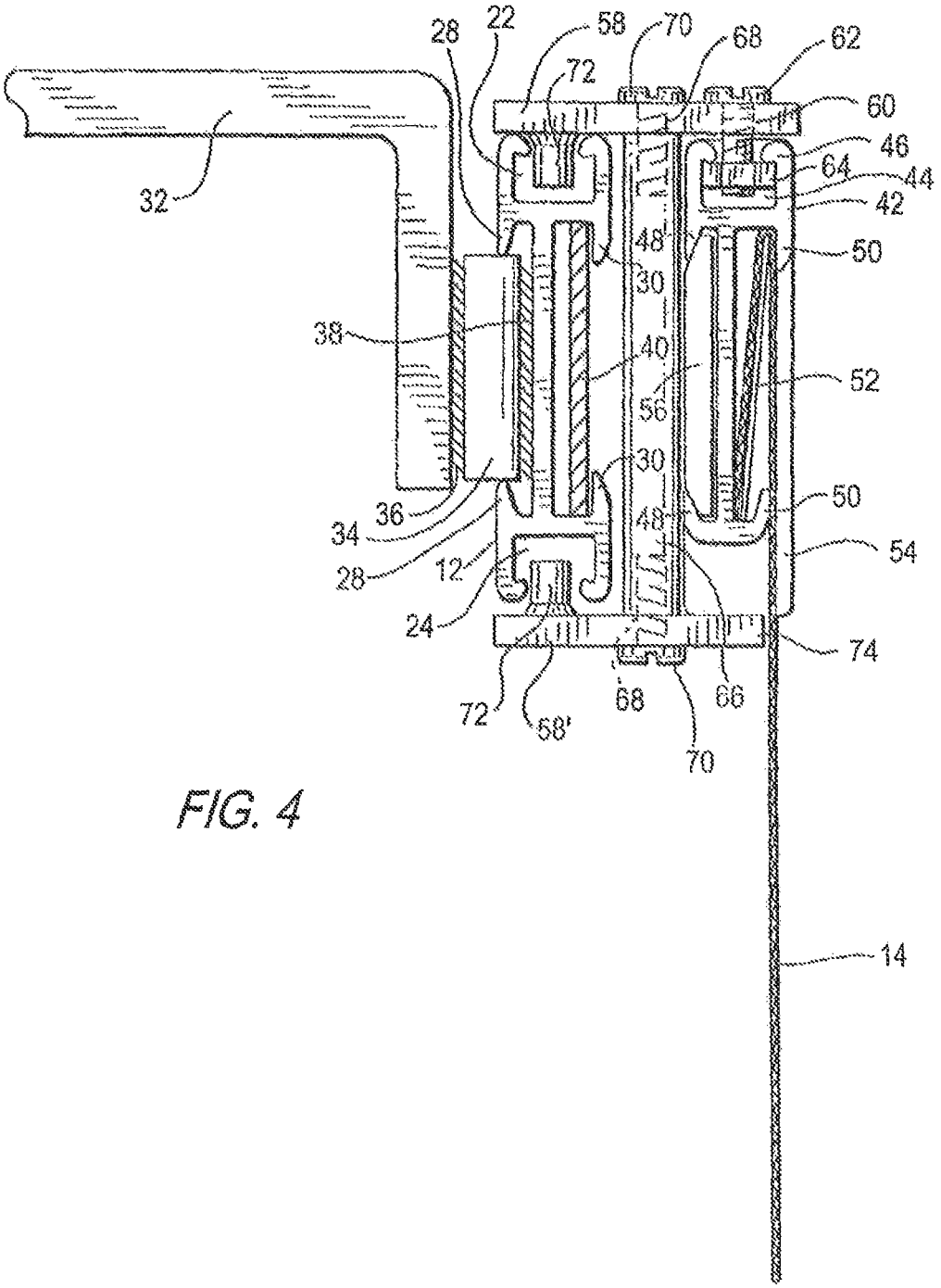
FIG. 4 is a cross-sectional view of the headrail, showing the mounting of a panel of the stacking panel covering thereon.

FIG. 4 is a cross-sectional view illustrating the manner in which headrail 12 may be mounted above an architectural opening. Bracket 32 may be mounted on and extended from the wall above or frame around an architectural opening. In practice, several such brackets 32 are so disposed at intervals above the architectural opening. A mounting block 34 is attached to the bracket 32, for example, using an adhesive 36. Mounting block 34 is sized so that it may provide an interference fit between prongs 28 on the rear of headrail 12.

This attachment may be made more secure through the use of an adhesive 38 between mounting block 34 and the rear of the headrail 12.

Prongs 30 on the front of the headrail 12 permit a decorative fabric insert 40 to be disposed on the front of the headrail 12. Preferably, the decorative fabric insert 40 is chosen to match the panels 14, 18, 20, although, of course, this need not be so.

The headrail 12 as a whole may be straight or linear; that is to say, it may extend parallel to the wall or frame from which it is mounted so that it will be equidistant therefrom at all points along its length. However, the headrail 12 and, it follows, embodiments of the present invention are not intended to be so limited. Specifically, the headrail 12 may alternatively be mounted so that it will be curved along one or more portions of its length. For example, the headrail 12 may be mounted so that it is closer to the wall or frame above the architectural opening at the extreme left and right of the stacking panel covering 10 than in the middle, so that the headrail 12 follows a curved path from the extreme left outward from the architectural opening and then back thereto at the extreme right. In short, the headrail 12 may be straight, but it need not be so, as it may alternatively be curved to some desired degree along its entire length or portions thereof. It follows that brackets 32 may be provided in more than one length to enable the mounting of a curved headrail 12 above an architectural opening.

Turning back to FIG. 4, the suspension of a panel 14 from headrail 12 is also shown. More specifically, FIG. 4 shows the manner in which the right-hand side of each panel 14, as well as those of panels 18, 20, is suspended from the headrail 12. Panel 14 is directly suspended from fabric rail 42, which is mounted in a manner which enables it to slide in either direction along headrail 12.

Figure 5:
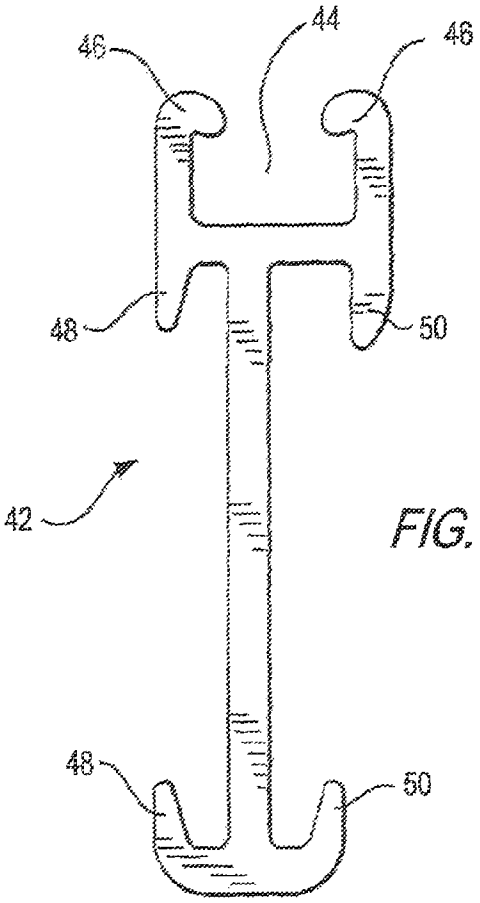
FIG. 5 is a cross-sectional view of a fabric rail from which a panel is suspended.

Referring now to FIG. 5, a cross-sectional view of fabric rail 42, which may be extruded from aluminum or plastic, shows that fabric rail 42 includes a U-shaped channel 44 having inwardly directed members 46 at the entrance thereof. Both sides of the fabric rail 42 have prongs, prongs 48 on the rear and prongs 50 on the front, whose purpose will be made clear below.

Returning to FIG. 4, panel 14 is held behind prongs 50 on the front of fabric rail 42 by stiffener 52, which is of a rigid sheet material, such as, for example, aluminum or plastic. Stiffener 52, along with panel 14 folded thereover, is slid behind prongs 50 from an end of the fabric rail 42, and prevents panel 14 from being readily pulled out.

At the far end of fabric rail 42 in the view presented in FIG. 4 is an end cap 54. The far end of end cap 54, not visible in FIG. 4, may have a planar surface. End cap 54 has a protruding member 56 on the near side thereof. Protruding member 56 is held behind prongs 48 on the rear of the fabric rail 42 by an interference fit which secures the end cap 54 thereto. End caps 54, there being one at each end of fabric rail 42, prevent panel 14 and stiffener 52 from sliding out, as well as improve the aesthetic appearance of the stacking panel covering 10. End caps 54 may be molded or machined from a plastic material.

Figure 6B:
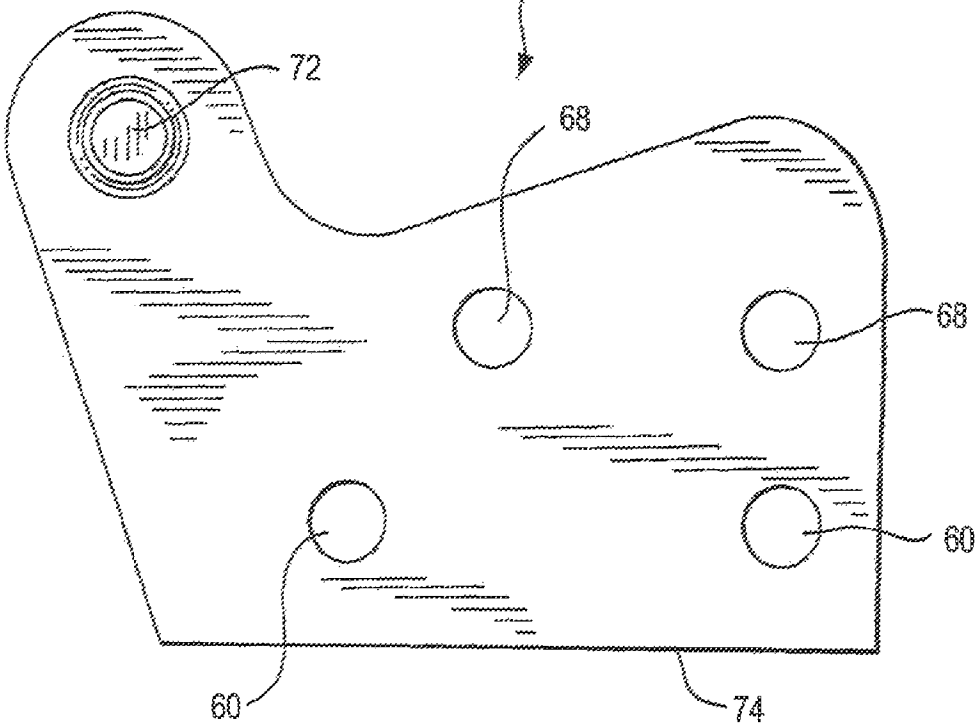
FIG. 6B is a plan view of the underside of the rail glide.
Figure 6A:
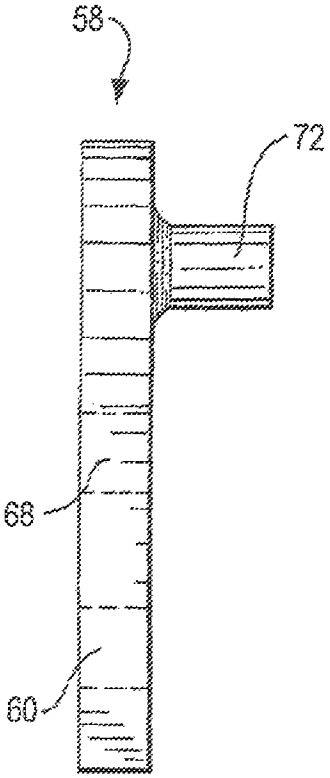
FIG. 6A is an end view of a rail glide for mounting a panel on the headrail.

Fabric rail 42 is mounted on and slidable along headrail 12 as follows. Referring to FIGS. 6A and 6B, rail glide 58 is shown in an end view in FIG. 6A, and, in FIG. 6B, as it would appear when viewed from the right in FIG. 6A. FIG. 6B, more specifically, is a plan view of the underside of rail glide 58.

Rail glide 58 may also be molded or machined from a plastic material, and has holes 60 which enable it to be attached to fabric rail 42. More specifically, screw 62 is directed through hole 60 and connected to nut 64 disposed in U-shaped channel 44. Inwardly directed members 46 at the entrance of U-shaped channel 44 hold nut 64 therewithin as screw 62 is tightened to complete the attachment of fabric rail 42 to rail glide 58.

Connecting member 66 joins rail glide 58 to rail glide 58', the latter being a mirror image of rail glide 58. Holes 68 in rail glide 58 and its mirror image rail glide 58' enable them (rail glides 58, 58') to be attached to connecting member 66 with screws 70. Connecting member 66 is sufficiently wider than headrail 22 to ensure that rail glides 58, 58' slide freely therealong.

Finally, the underside of rail glide 58 includes a projecting lug 72, as does the top of rail glide 58'. Lugs 72 are disposed within upper U-shaped channel 22 and lower U-shaped channel 24 of headrail 12, and provide the attachment of rail glides 58, 58' thereto. It will finally be noted that edge 74 of rail glide 58' may be trimmed somewhat relative to that of rail glide 58 so as not to cause an unsightly bulge in freely suspended panel 14.

Figure 7:
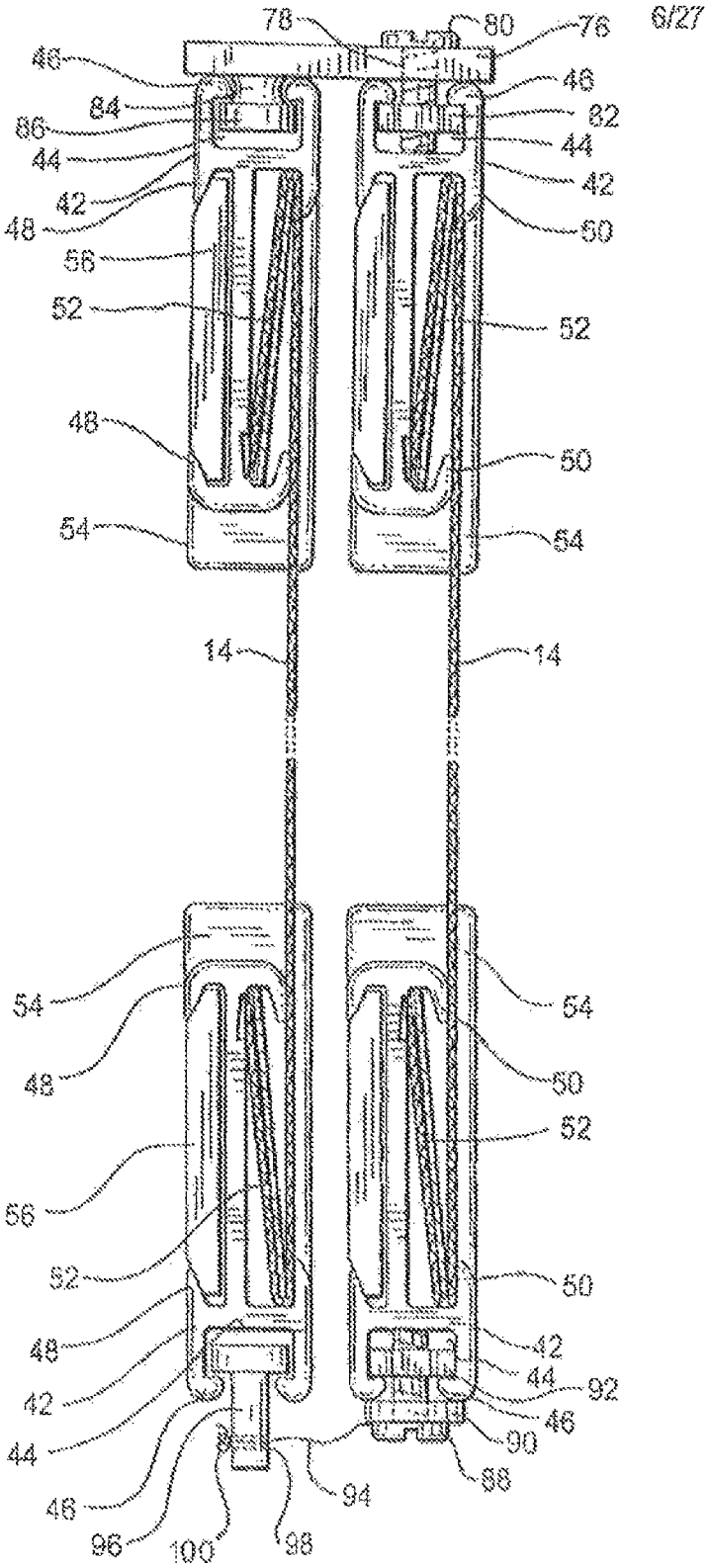
FIG. 7 is a cross-sectional view of two adjacent panels of the stacking panel covering.

With reference now to FIG. 7, this is a cross-sectional view showing the manner in which one panel 14 is connected to another panel 14 both at the top and at the bottom of the stacking panel covering 10. At the top of FIG. 7 are fabric rails 42 for two adjacent panels 14, including stiffeners 52 and end caps 54. Attached to the fabric rail 42 on the right, which would also be on the right if viewed in FIGS. 1 and 2, is a piggyback glide 76.

Figure 8B:
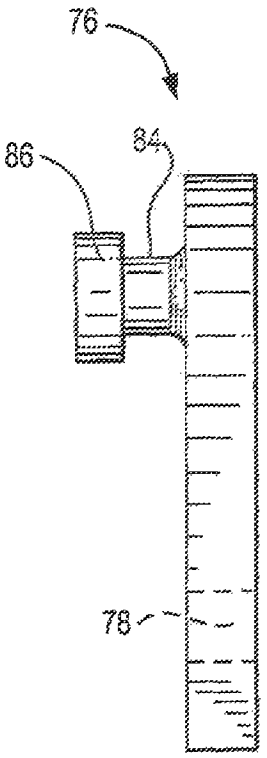
FIG. 8B is an end view of the piggyback glide.
Figure 8A:
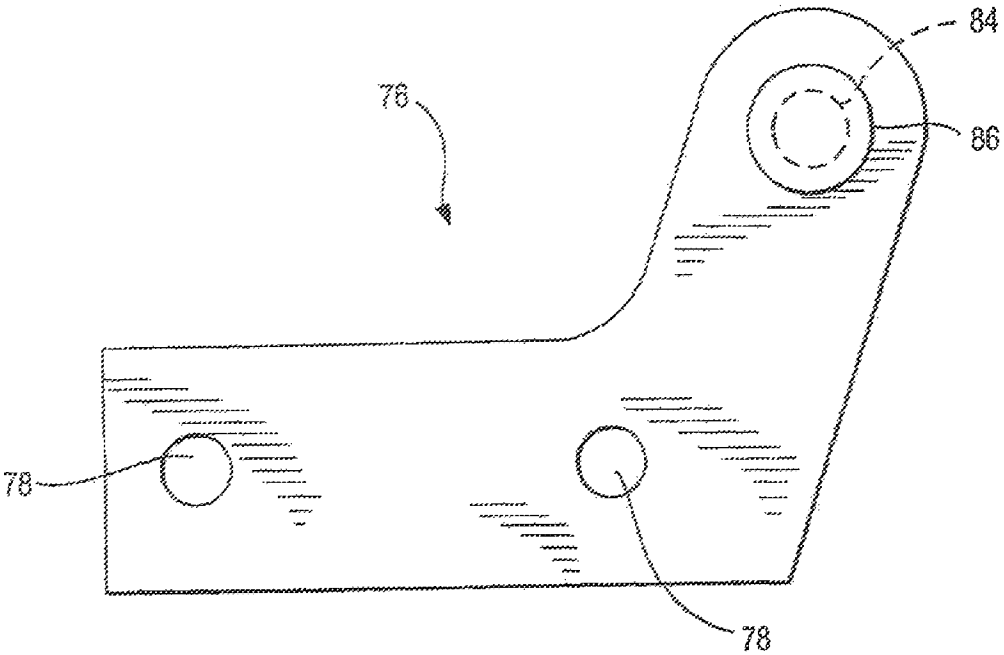
FIG. 8A is a plan view of a piggyback glide for linking one panel to the next.

Piggyback glide 76 is shown in a plan view of its underside in FIG. 8A, and, FIG. 8B, in an end view as it would appear when viewed from the right in FIG. 8A. Piggyback glide 76 may also be molded or machined from a plastic material, and has holes 78 which enable it to be attached to fabric rail 42. More specifically, screw 80 is directed through hole 78 and connected to nut 82 disposed in U-shaped channel 44. Inwardly directed members 46 at the entrance of U-shaped channel 44 hold nut 82 therewithin as screw 80 is tightened to complete the attachment of piggyback glide 76 to fabric rail 42.

The underside of piggyback glide 16 includes a projecting lug 84 with a relatively wider distal portion 86. Projecting lug 84 is disposed within U-shaped channel 44 of the adjacent fabric rail 42. Inwardly directed members 46 at the entrance of U-shaped channel 44 hold distal portion 86 within U-shaped channel 44, thereby joining one panel 14 to its neighbor.

Referring now to the bottom of FIG. 7, fabric rails 42 are also located at the bottom of each panel 14, where they are in an orientation which is inverted relative to those at the top. Stiffeners 52 and end caps 54 are also included as at the top. U-shaped channels 44 with inwardly directed members 46 are now oriented in a downward direction. Attached to the fabric rail 42 on the right, which, as noted above, would also be on the right if viewed in FIGS. 1 and 2, is a screw 88, a washer 90 and a nut 92. Screw 88 is directed through washer 90 and into nut 92, which is disposed within U-shaped channel 44, where inwardly directed members 46 hold nut 92 therewithin as screw 88 is being tightened.

Figure 9A:
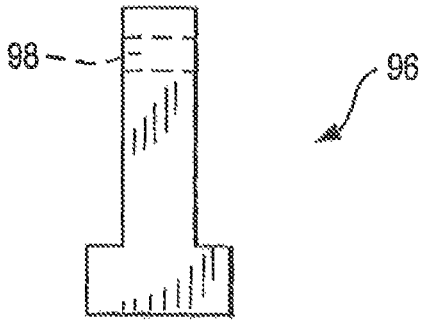
FIG. 9 A is an end view of a bottom slide included in FIG. 7.
FIG. 9B is a side view of the bottom slide.
Figure 9B:
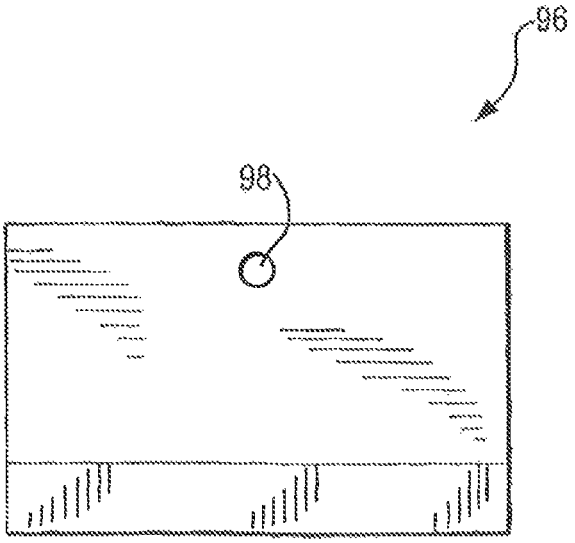

Screw 88, preferably disposed on the lower left side of a panel 14, 20 as viewed in FIGS. 1 and 2, anchors a filament 94 which connects the right panel in FIG. 7 to a bottom slide 96 in the U-shaped channel 44 of the fabric rail 42 of the panel 14 on the left side of FIG. 7. Bottom slide 96 may also be molded or machined from a plastic material, and is shown in an end view in FIG. 9A and in a side view in FIG. 9B. As shown in FIG. 9A, the bottom slide 96 has a T-shaped cross section. A hole 98 is directed through the upright portion of the T-shaped cross section. The bottom slide 98 is disposed in the U-shaped channel 44 as shown, the inwardly directed members 46 being separated by less than the width of the top of the T-shaped cross section to hold the bottom slider 96 therein. The filament 94 passes through hole 98 and knot too prevents it from being withdrawn. It should be understood that each panel 14, 18, 20 is joined to its neighbor in this manner to ensure that the panels 14, 18, 20 do not swing and twist uncontrollably as the stacking panel covering 10 is being opened or closed.

Figure 10:
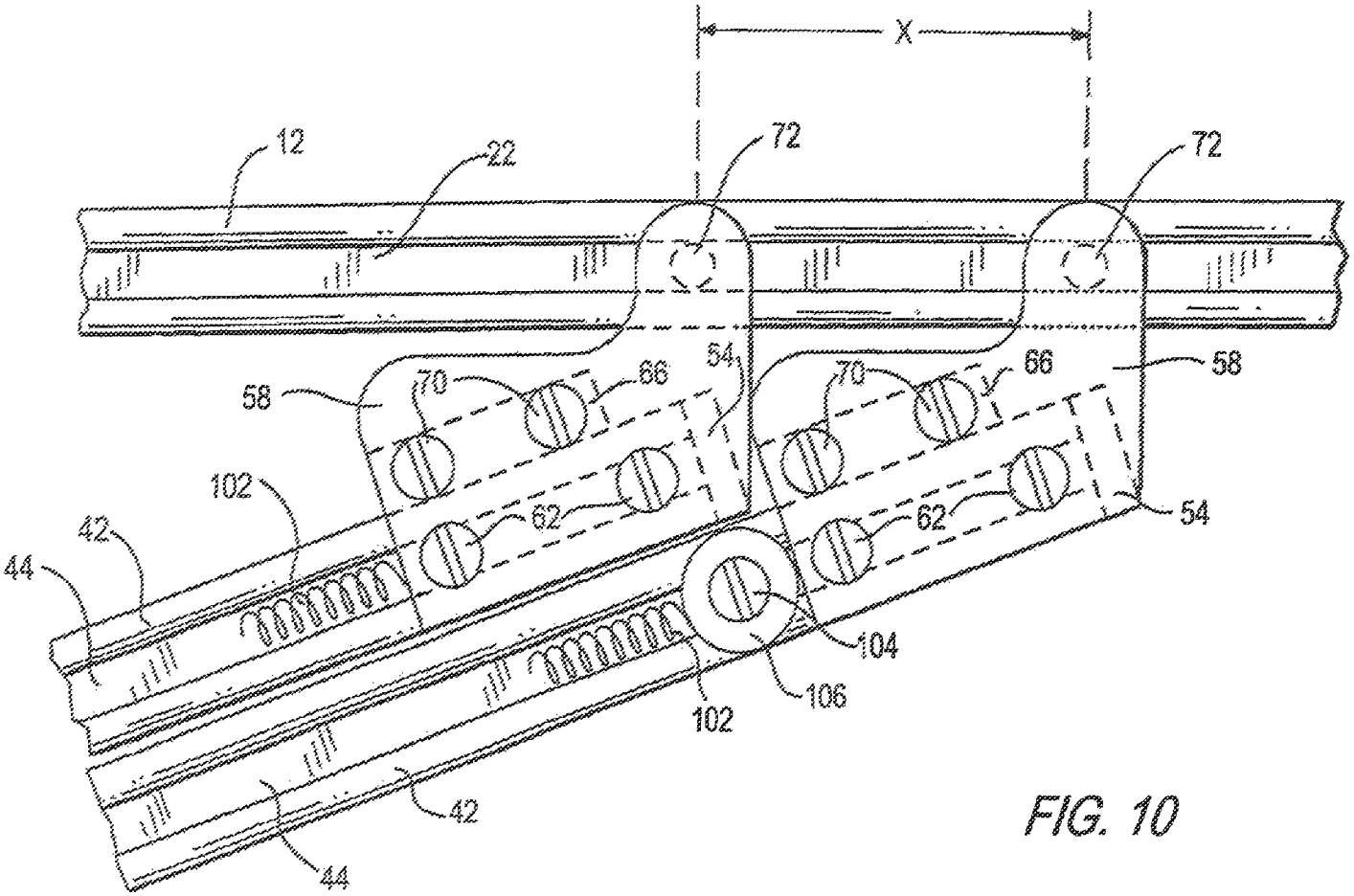
FIG. 10 is a plan view from above the headrail of rail glides and fabric rails for two adjacent panels.

FIG. 10 is a plan view from above the headrail 12 of the rail glides 58 and fabric rails 42 for two adjacent panels 14, others being omitted for the sake of clarity, when the stacking panel covering 10 is in the fully opened condition shown in FIG. 2. It should be understood that all panels 14, 18, 20 would have the same appearance if included in FIG. 10, except that rightmost panel 20 would be immobilized, perhaps through the use of stop screws on opposite sides of the connection of rail glide 58 to upper U-shaped channel 22 of headrail 12. It will be noted that, because of the shape and design of rail glide 58, their closest separation is the distance "X" in FIG. 10. Distance "X" may be referred to as the stacking distance. Except for rightmost panel 20, there may also be springs 102 located in U-shaped channels 44 as shown in FIG. 10. Springs 102 are provided optionally at the positions shown in FIG. 10 to gently brake the motion of the panels 14, 18 when the stacking panel covering 10 is being closed. Screw 104 and washer 106, there also being a nut, like nut 64 in FIG. 4 within U-shaped channel 44 but not visible in FIG. 10, which may be provided as a spacing adjuster between adjacent panels 14, 18 when the stacking panel covering 10 is fully closed. It should be noted that fabric rails 42 make an oblique angle relative to the headrail 12; it should be understood that they may be curved or arcuate to give the individual curved panels 14, 18, 20 the shape described above. As a consequence, fabric rails 42 curve back toward headrail 12 at an oblique angle as shown in FIG. 11.

Figure 11:
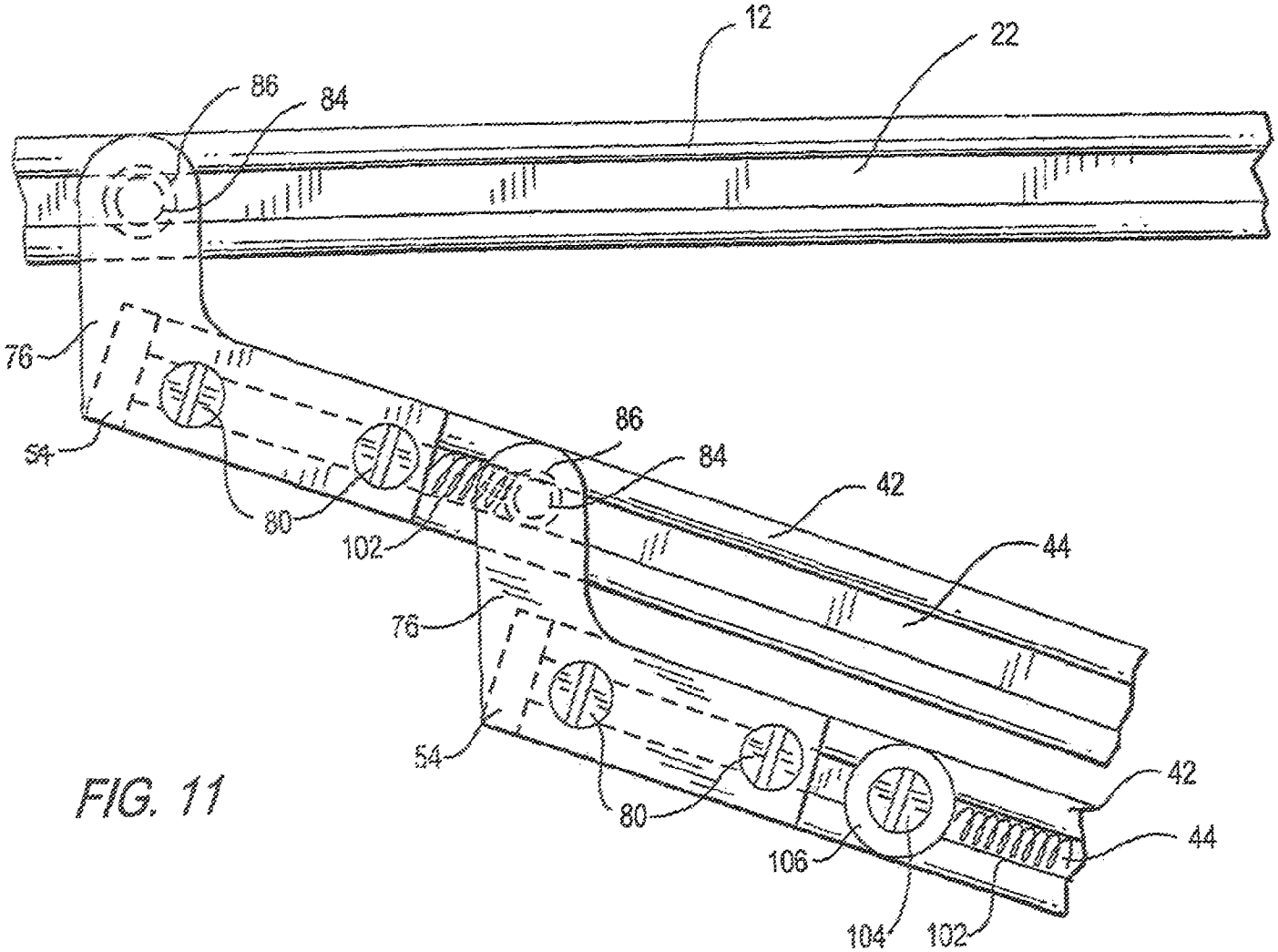
FIG. 11 is a plan view from above the headrail of piggyback glides and fabric rails for two adjacent panels.

FIG. 11 is a plan view from above the headrail 12 of the piggyback glides 16 and fabric rails 42 for leftmost panel 18 and panel 14 immediately adjacent thereto, others being omitted for the sake of clarity, when the stacking panel covering 10 is in the fully opened condition shown in FIG. 2. It should be understood that the remaining panels 14, 18 would all connect, one to the next, in the manner that one attaches to the other in FIG. 11. Leftmost panel 18 is attached to the headrail 12 by means of piggyback glide 76. The remaining panels 14, 20 "piggyback" on those immediately to their left as shown in FIG. 11. Springs 102 are provided optionally at the positions shown in FIG. 11 to gently brake the motion of the panels 14, 18 when the stacking panel covering 10 is being opened. Screw 104 and washer 106, there again also being a nut, like nut 64 in FIG. 4, within U-shaped channel 44 but not visible in FIG. 11, which may be provided as a spacing adjuster between adjacent panels 14, 18 when the stacking panel covering 10 is fully opened.

Although not shown in FIG. 11, rod 16 may be attached to leftmost panel 18 using screws 80, which may also secure a bracket from which rod 16 may be suspended in addition to attaching piggyback glide 76 to fabric rail 42.

Finally, leftmost panel 18 may have a bar extending from the top fabric rail 42 to the bottom fabric rail 42 on the rear of the panel 18. Preferably, the bar is disposed on the right edge of the leftmost panel 18, so as to remain hidden whether the stacking panel covering 10 is opened or closed. The bar is provided to give the leftmost panel 18 more rigidity and weight, so that it will have less tendency to swing outwardly when the stacking panel covering 10 is being opened in response to forces generated as it is moved relative to the surrounding air.

Figure 12:
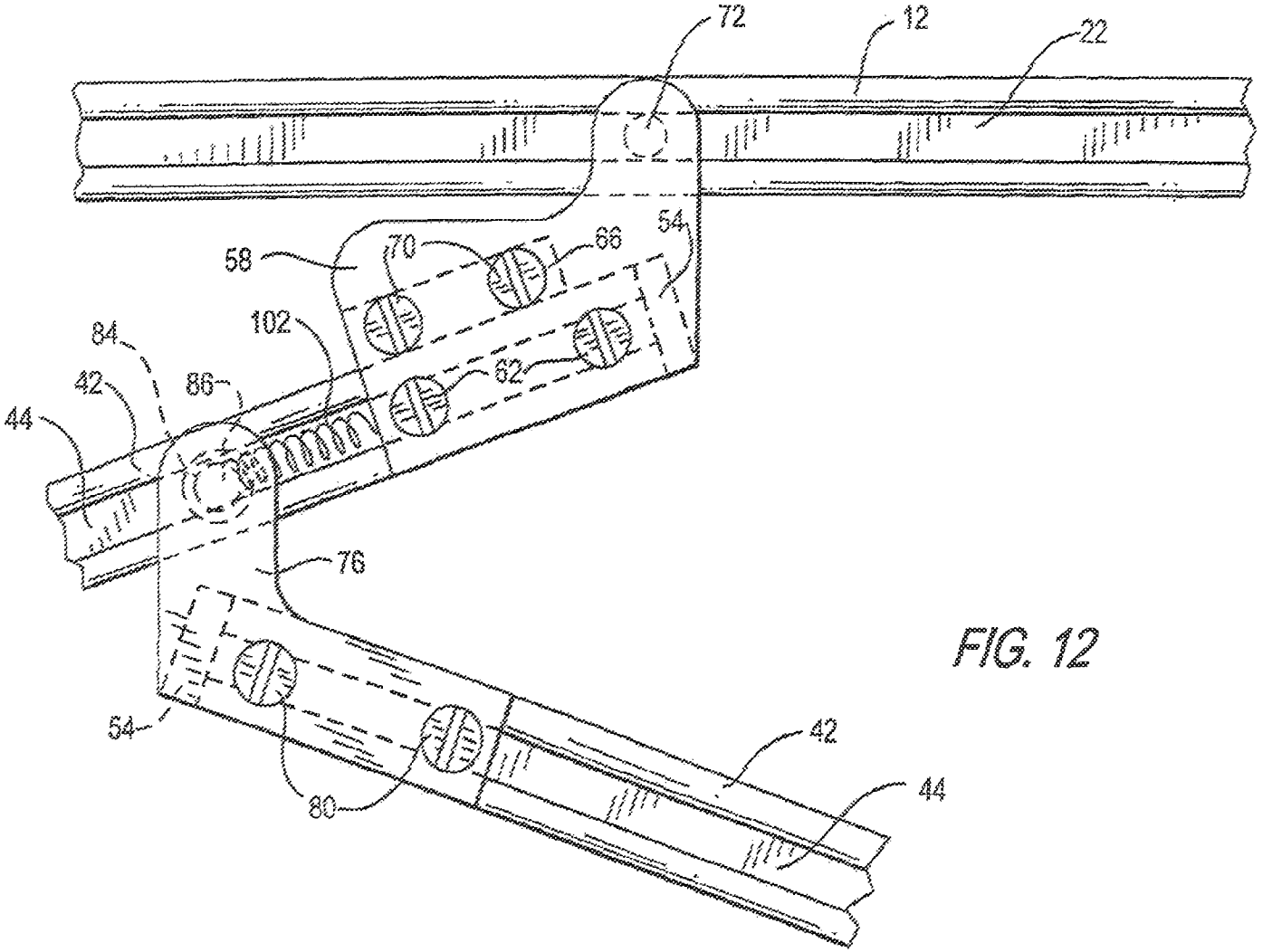
FIG. 12 is a plan view from above the headrail of the connection between two adjacent panels when the stacking panel covering is fully closed.

FIG. 12 is a plan view from above the headrail 12 of the connection between two adjacent panels 14 when the stacking panel covering 10 is in the fully closed condition shown in FIG. 1. Each panel 14, 18, 20 is joined to the next in this manner, that is, "piggybacked" on that to its left except for the leftmost panel 18, which is "piggybacked" onto the headrail 12. As previously noted during the discussion of FIG. 10 above, spring 102 in U-shaped channel 44 is provided optionally to gently brake the motion of panels 14, 18 when the stacking panel covering 10 is being closed.

Figure 13:
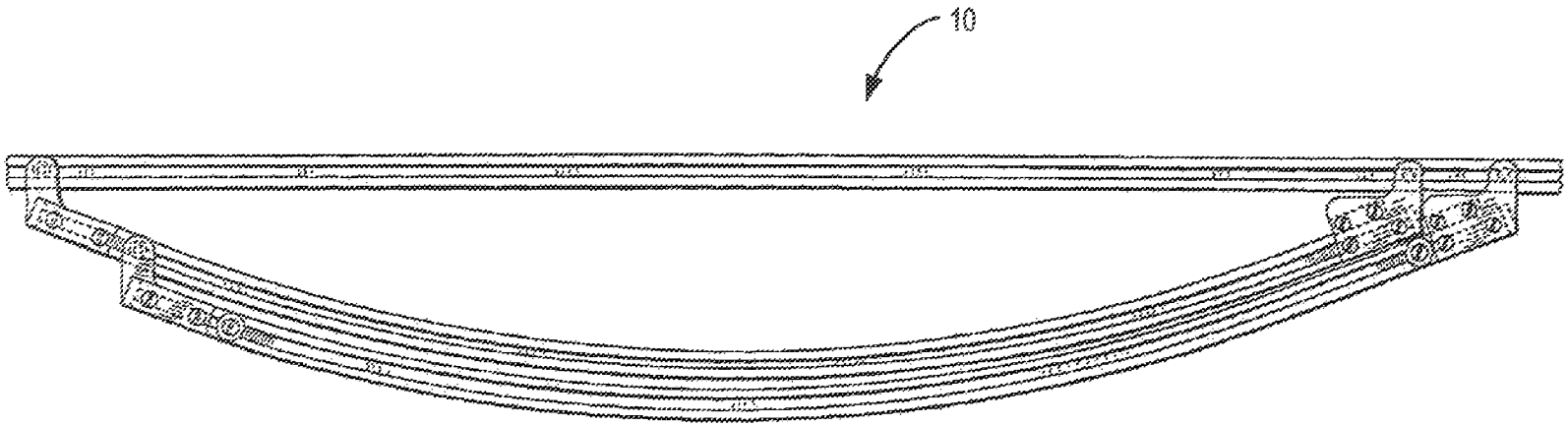
FIG. 13 is a plan view from above the headrail of two adjacent panels when stacked relative to one another.

FIG. 13 is a plan view from above the headrail of two adjacent panels when stacked relative to one another, and may be recognized to be a combination of FIGS. 10 and 11 to show the complete width of the two adjacent arcuate or curved panels 14 shown in those figures.

Figure 14:
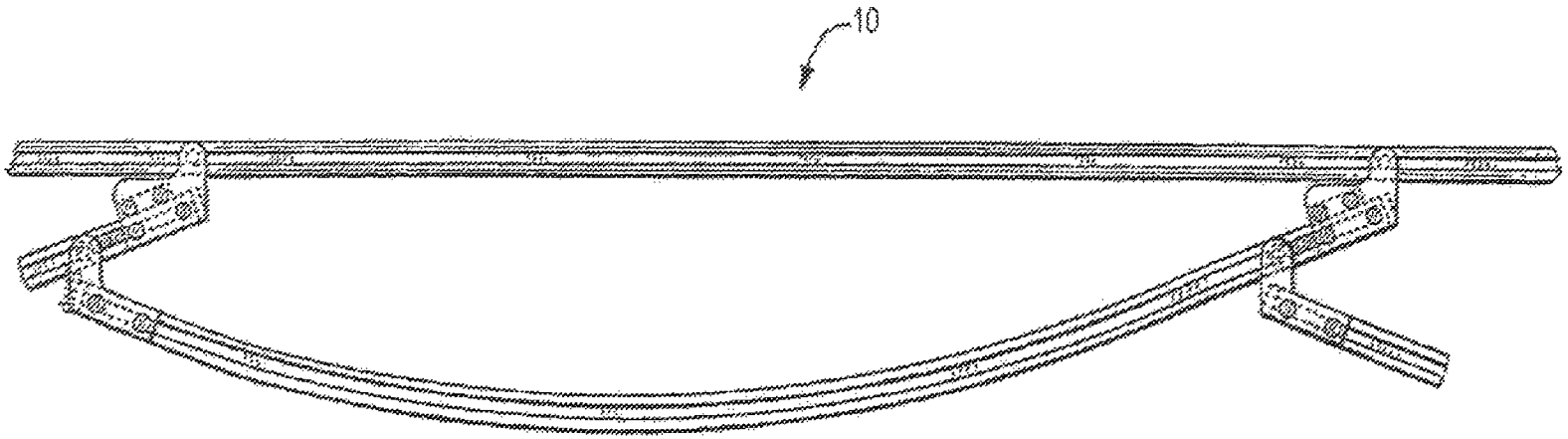
FIG. 14 is a plan view from above the headrail of a panel and its connections to adjacent panels when the stacking panel covering is fully closed.

Similarly, FIG. 14 is a plan view from above the headrail of a panel and its connections to adjacent panels when the stacking panel covering is fully closed, and shows the complete width of arcuate or curved panels between the connections shown in FIG. 12.

Figure 15:
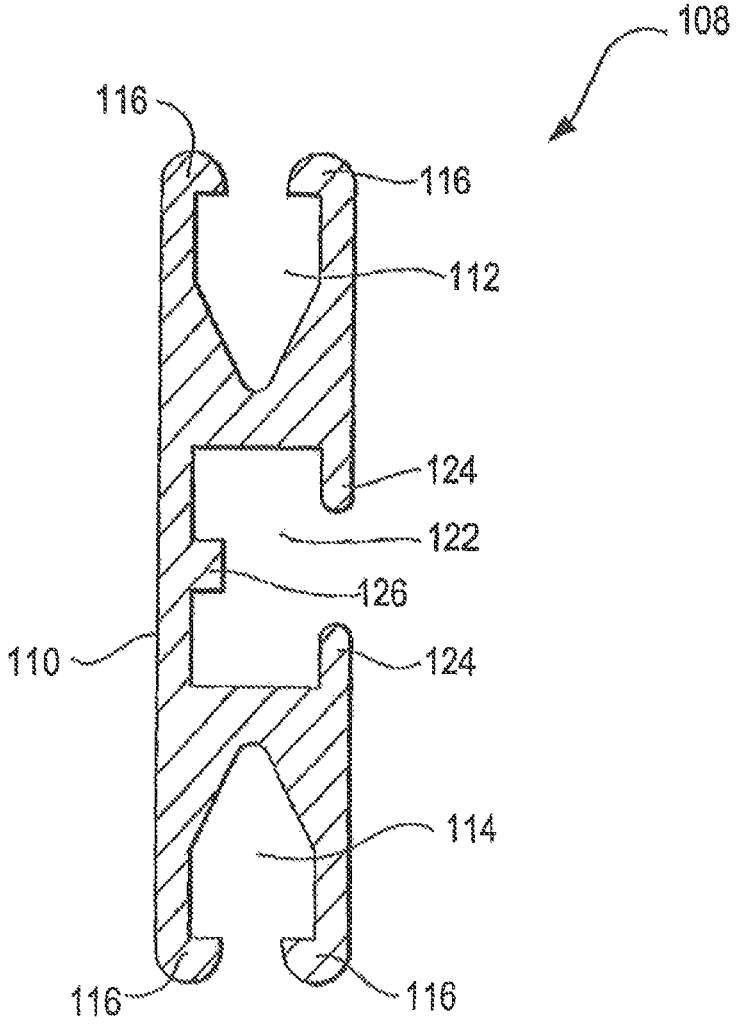
FIG. 15 is a cross-sectional view of a rail usable as a headrail or fabric rail.

The stacking panel covering 10 may be modified in several ways without departing from the scope of the present invention. For example, FIG. 15 is a cross-sectional view of a rail 108 which may be used in place of either headrail 12 or fabric rail 42.

Rail 108 has a smooth face 110, which faces the viewer of stacking panel covering 10 within the room in which it is installed. Rail 108 also has an upper V-shaped channel 112 and a lower V-shaped channel 114, each of which has hook-like members 116 extending toward one another at its opening.

Figure 16B:
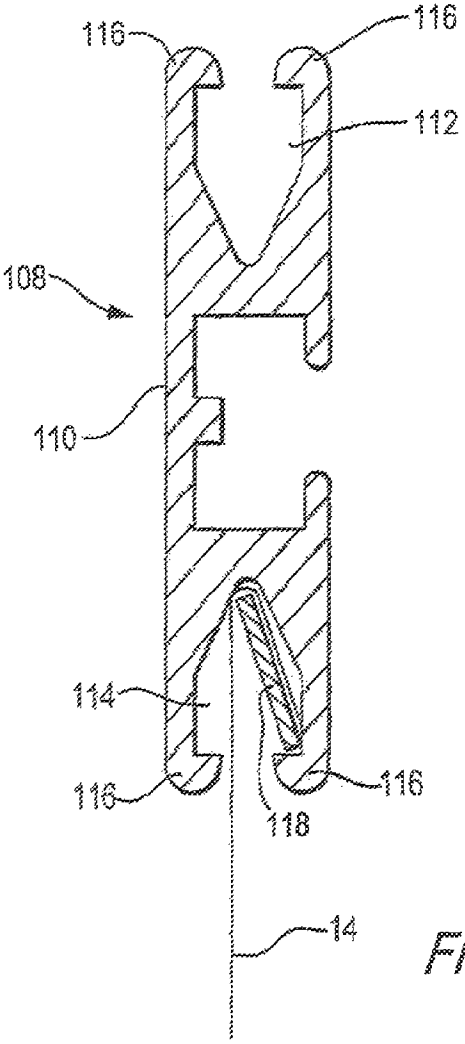
FIG. 16B is a cross-sectional view of the same rail in use as a top fabric rail.
Figure 16A:
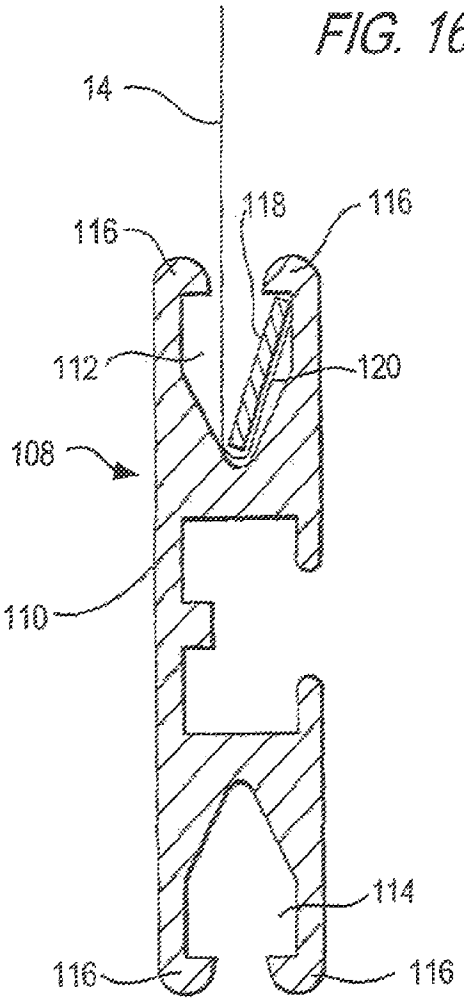
FIG. 16A is a cross-sectional view of the rail of FIG. 15 in use as a bottom fabric rail.

Panels 14, 18, 20 are secured in upper V-shaped channel 112, when rail 108 is used as a lower fabric rail, and in lower V-shaped channel 114, when rail 108 is used as an upper fabric rail. These alternatives are shown in FIGS. 16A and 16B, respectively. In either case, a strip 118 of plastic material, seen in cross section in FIGS. 16A and 16B, secures panel 14 in upper V-shaped channel 112 or lower V-shaped channel 114, respectively. In FIG. 16 A, panel 14 extends downwardly into upper V-shaped channel 112, under strip 118 and around to the backside 120 thereof, where it may be secured by an adhesive. Hook-like member 116 prevents panel 14 and strip 118 from being pulled upwardly and out, or more precisely, it prevents rail 108 from falling off of panel 14. In FIG. 16B, where rail 108 is used as an upper fabric rail, panel 14 extends upwardly into lower V-shaped channel 114, over strip 118 and around to the backside thereof, where it may be secured by an adhesive. Hook-like member 116 prevents panel 14 and strip 118 from being pulled downwardly and out, particularly by the weight of a lower fabric rail.

Referring again to FIG. 16 A, lower V-shaped channel 114 may be used for the same purpose as that previously illustrated at the bottom of FIG. 7 for U-shaped channels 44 of fabric rails 42, namely, the linking of panels 14 together at the bottoms thereof. An example will be provided below.

In addition, referring to FIG. 16B, upper V-shaped channel 112 may be used for the same purposes as that shown previously in FIG. 4 and at the top of FIG. 7, namely, to mount rail glides 58 and piggyback glides 76 to attach panels 14, 18, 20 to headrail 12 and to connect panels 14, 18, 20 to each other. Moreover, rail 108 may be used as headrail 12 in FIG. 4, in which case the upper and lower V-shaped channels 112, 114 function in the same manner as upper and lower U-shaped channels 22, 24 of headrail 12.

Referring now to FIG. 15, the rear side of rail 108, that is, the side away for the viewer of stacking panel covering 10 within the room in which it is installed, has a channel 122 of generally rectangular cross-sectional shape. The channel 122 has a flange 124 on each side of its opening and a rail 126 within the channel 122 and opposite to the flanges 124. Channel 122 may be used in connecting each panel 14 to its neighbors when rail 108 is used as a bottom fabric rail. When rail 108 is used as a headrail 12, channel 122 may be used in mounting the stacking panel covering above and in front of an architectural opening.

Figure 17:
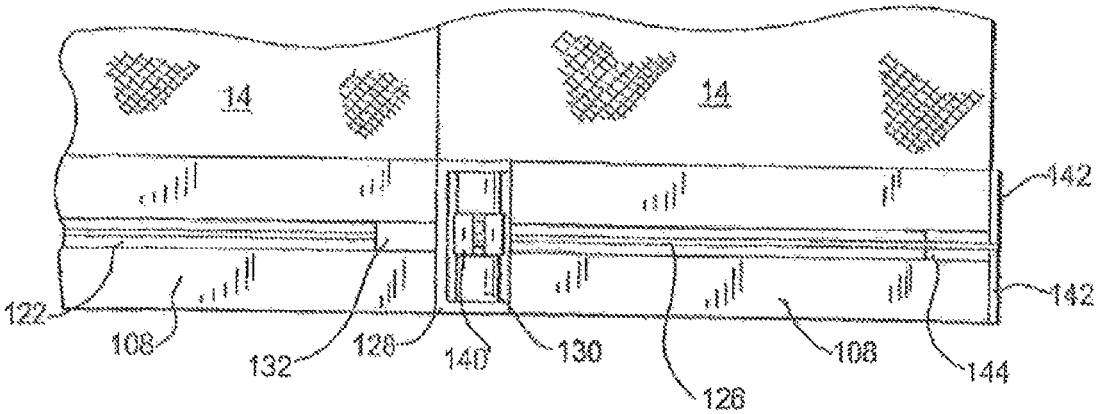
FIG. 17 is a plan view showing the connection of one bottom fabric rail to the next.
Figure 18:
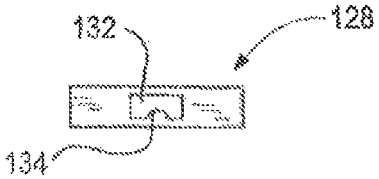
FIG. 18 is a plan view of the end of a coupling member included in FIG. 17.

FIG. 17 is a plan view, taken from behind two adjacent panels 14 of a stacking panel covering, showing the connection of one bottom fabric rail to the next, where rail 108 is used as the bottom fabric rail. At the end of rail 108 on the left-hand side of FIG. 17 is a coupling member 128 having a generally rectangular opening 130. Coupling member 128 is disposed at the hidden end of each rail 108 on movable panels 14, that is, all panels 14 except the fixed panel at the extreme left or right of the stacking panel covering 10. FIG. 18 is a plan view of the end of the coupling member 128 inserted into bottom rail 108 in FIG. 17. Insert member 132 fits snugly in channel 122 and behind flanges 124 in rail 108, and has a cut-out 134 to accommodate rail 126.

Figure 19:
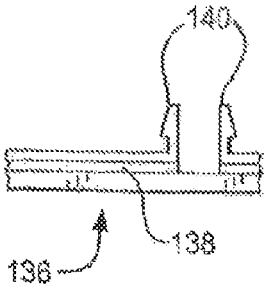
FIG. 19 is a side view of a linking member included in FIG. 17.

Linking member 136 is shown in a side view in FIG. 19. Linking member 136 is slidable along channel 122 in rail 108 guided by flanges 124, which fit within groove 138 on each side of linking member 136, and against rail 126. Resilient locking members 140 snappingly fit within rectangular opening 130 to join one panel 14 to that behind it. The visible ends of rails 108 have end caps 142 as shown in FIG. 17.

Figure 20:
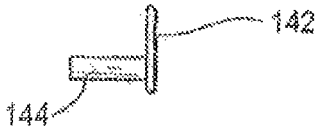
FIG. 20 is a plan view if an end cap appearing in FIG. 17.

A plan view of an end cap 142 is provided in FIG. 20. Insert member 144 of end cap 142 fits snugly within channel 122 in the space between one of the two flanges 124 and rail 126. Two end caps 142, oriented in opposite directions, are required to cover the end of the rail 108.

Figure 21:
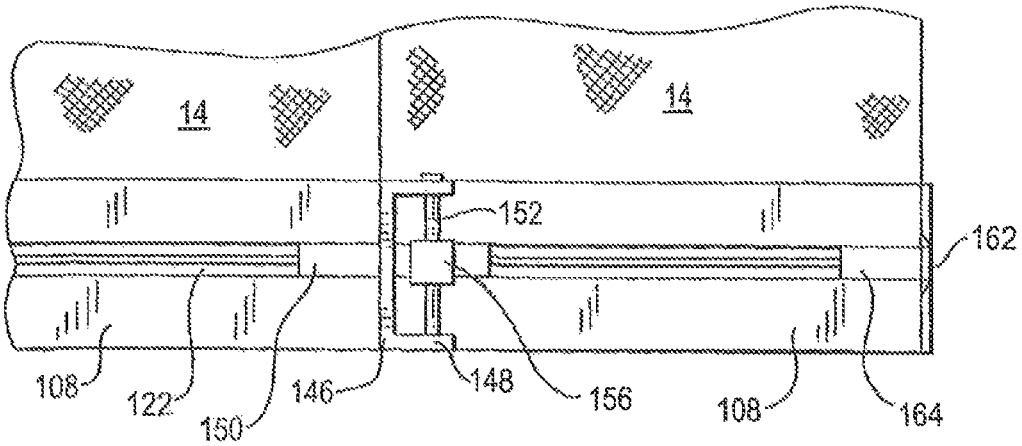
FIG. 21 is a plan view showing another approach toward connecting one bottom fabric rail to the next.
Figure 22:
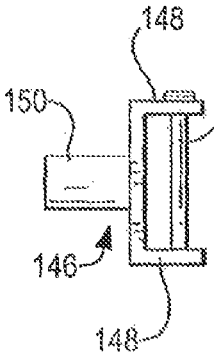
FIG. 22 is a plan view of a coupling member included in FIG. 21.
Figure 23:
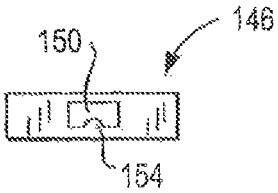
FIG. 23 is a plan view of the end of the coupling member shown in FIG. 22.

FIG. 21, which is a plan view analogous to FIG. 17, shows an alternate approach for connecting one bottom fabric rail to the next, where rail 108 is used as the bottom fabric rail. At the end of rail 108 on the left-hand side of FIG. 21 is a coupling member 146 which is generally in the shape of a fork having two tines 148 and an insert member 150, as shown in FIG. 22. Spanning across the space between the tines 148 is a pin 152. Coupling member 146 is disposed at the hidden end of each rail 108 on movable panels 14, that is, all panels 14 except the fixed panel at the extreme right or left of the stacking panel covering. FIG. 23 is a plan view of the end of coupling member 146 inserted into the bottom rail 108 in FIG. 21, and is identical to FIG. 18. Insert member 150 fits snugly in channel 122 and behind flanges 124 in rail 108, and has a cut-out 154 to accommodate rail 126.

Figure 24:
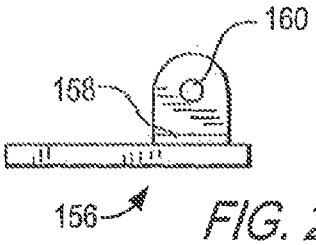
FIG. 24 is a plan view of a linking member included in FIG. 21.

Linking member 156 is shown in a side view in FIG. 24. Linking member 156 is slidable along channel 122 in rail 108 guided by flanges 124, which fit within a groove 158 on each side of linking member 156, and against rail 126. Linking member 156 has a hole 160 through which pin 152 passes to join coupling member 146 to linking member 156.

Figure 25:
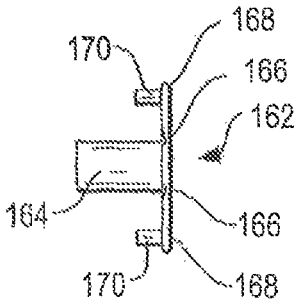
FIG. 25 is a plan view of an end cap appearing in FIG. 21.

The visible ends of rails 108 may have end caps 162 as shown in FIG. 21. A plan view of an end cap 162 is provided in FIG. 25. Insert member 164 of end cap 162 fits snugly within channel 122 behind flanges 124. End cap 162 further has living hinges 166 enabling distal portions 168 thereof to be opened away from upper and lower V-shaped channels 112, 114 without removing the end cap 162 completely from the end of rail 108. Each distal portion 168 has a nub 170, which fits against hook-like members 116 in upper and lower V-shaped channels 112, 114 to hold distal portions 168 closed over the end of rail 108.

Figure 26:
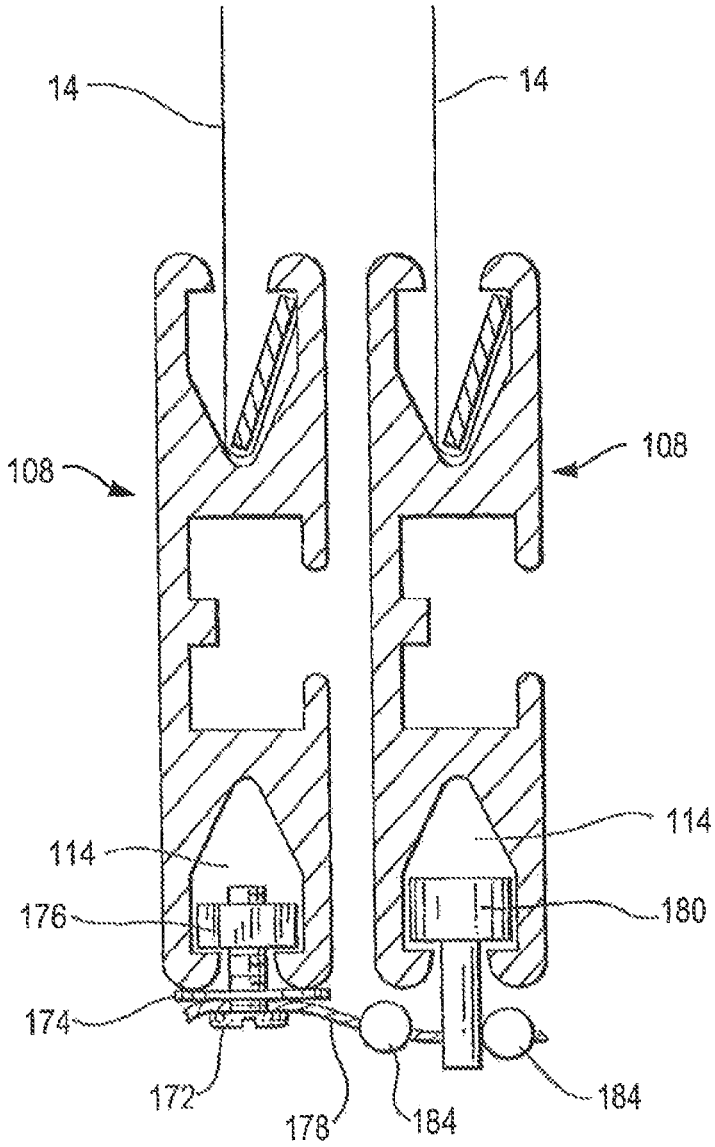
FIG. 26 is a cross-sectional view of the bottom of two adjacent panels showing yet another means for connecting them to one another.

In yet another alternative approach for connecting one bottom fabric rail to the next, FIG. 26 illustrates a view like that previously shown in FIG. 7 for two adjacent panels 14. Referring to the lower V-shaped channels 114 in the two adjacent rails 108, that on the left-hand side in FIG. 26 has a screw 172, a washer 174 and a nut 176. Screw 172 is directed through washer 174 and into nut 176, which is disposed within lower V-shaped channel 114, where hook-like members 116 hold nut 176 therewithin as screw 172 is being tightened.

Figure 27:
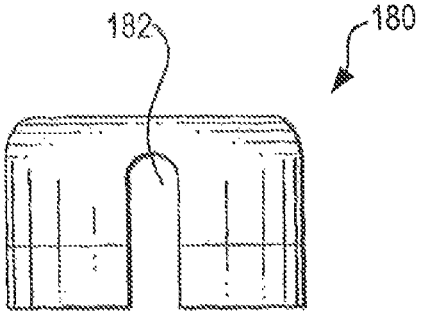
FIG. 27 is a side view of a bottom slide shown in an end view in FIG. 26.

Screw 172, which is disposed adjacent to one of the two ends of rail 108, anchors a beaded cord 178 which connects the left panel 14 in FIG. 26 to a bottom slide 180 in the lower V-shaped channel 114 of rail 108 of panel 14 on the right-hand side of FIG. 26. Bottom slide 180 may also be molded or machined from a plastic material, and is shown in a side view in FIG. 27. As seen in FIG. 26, bottom slide 180 has a T-shaped cross section. Viewed from the side as in FIG. 27, bottom slide 180 has a slot 182 through the horizontal portion of the T-shaped cross section and through that part of the upright portion closest to the horizontal portion. The bottom slide 180 is disposed n lower V-shaped channel 114 as shown, the horizontal portion of the T-shaped cross section being held therein by hook-like members 116. Before being so disposed, beaded cord 178 is placed into slot 182 such that one bead 184 is on either side of the upright portion of the T-shaped cross section. Slot 182 has a width less than the diameter of beads 184, so that beaded cord 178 cannot be pulled through the slot 182, particularly when bottom slide 180 is disposed in lower V-shaped channel 114.

Figure 28:
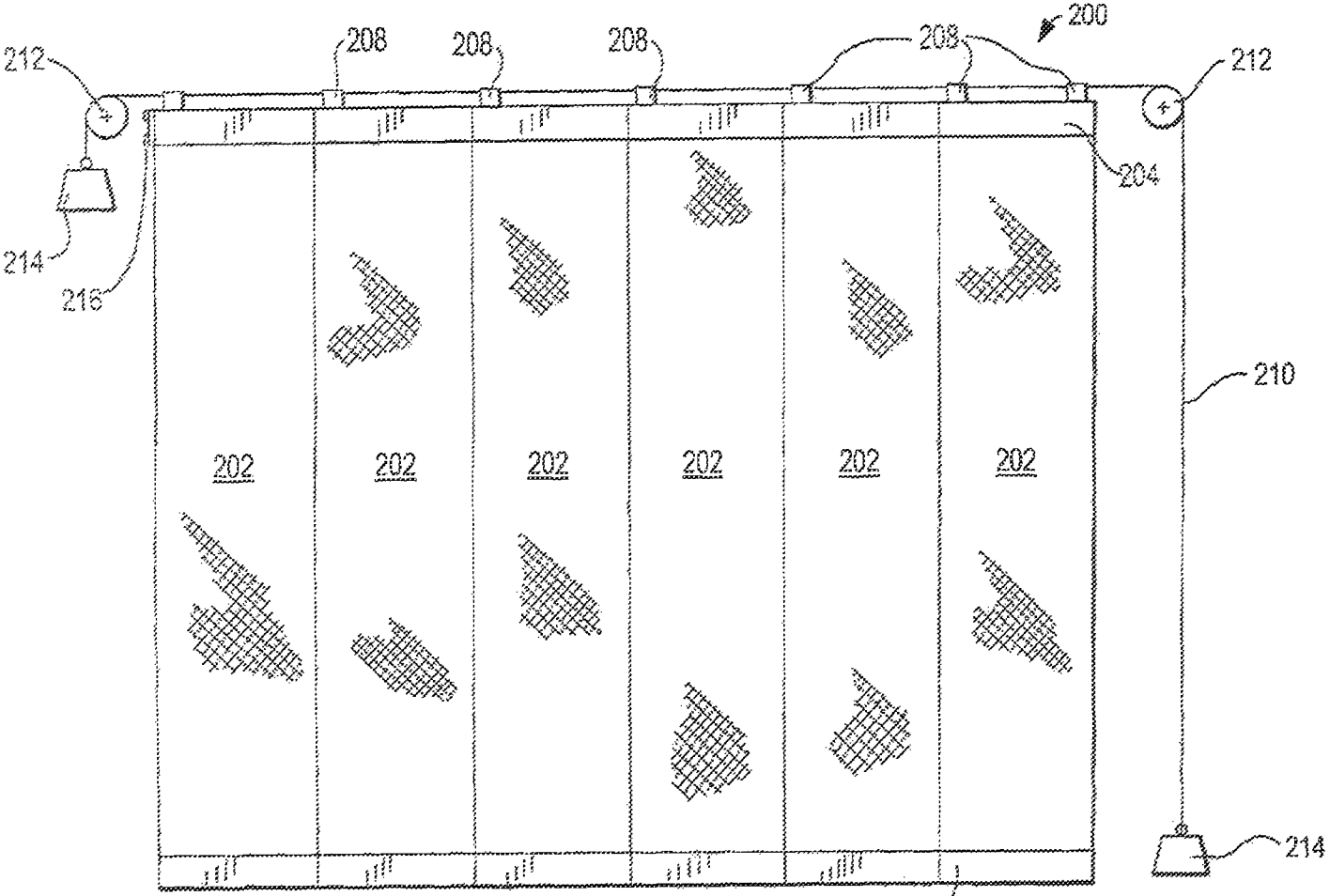
FIG. 28 is a plan view of an alternate embodiment of the stacking panel covering of the present invention when closed.
Figure 29:
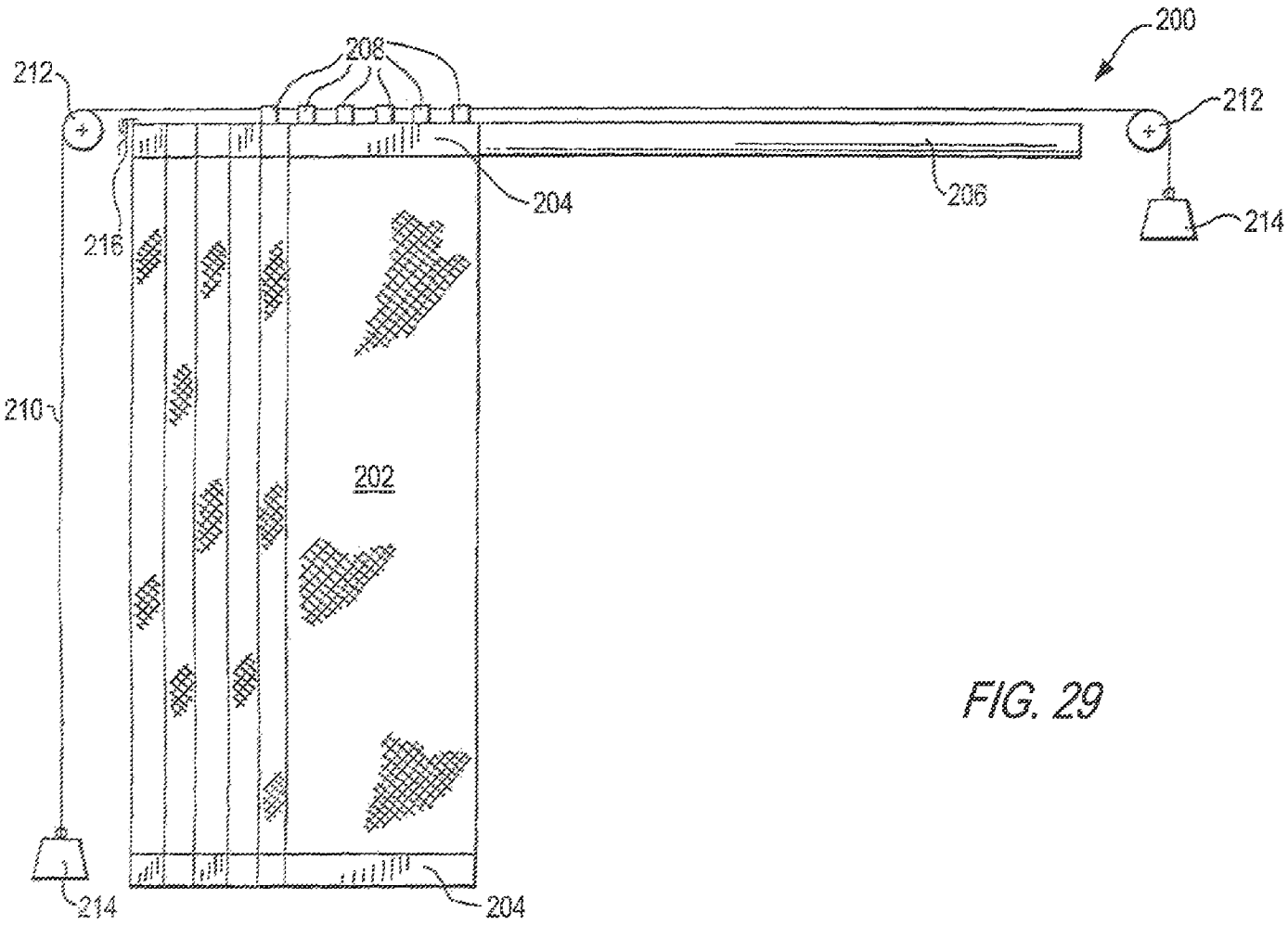
FIG. 29 is a plan view of the stacking panel covering of FIG. 28 when fully opened.

An alternate embodiment of the stacking panel covering of the present invention is shown closed and opened in FIGS. 28 and 29, respectively. Turning first to FIG. 28, stacking panel covering 200 comprises six panels 202. At the top and bottom of each are fabric rails 204, which may be rails 108 shown in FIG. 15 as well as in others of the figures discussed above. Panels 204 are suspended from a headrail 206, which is visible in FIG. 29 showing the stacking panel covering 200 when opened. Rail 108 may also be used as headrail 206. Each panel has a driving block 208 associated with each panel in a manner to be shown more specifically below. A cord 210 is used to open and close stacking panel covering 200. At the upper right- and left-hand corners thereof are pulleys 212 around which the cord 210 passes. Cord 210 is maintained in a taut condition by weights 214 which are attached to each end of the cord 210 below the pulleys 212.

The stacking panel covering 200 may be opened from the closed condition shown in FIG. 28 by raising cord 210 on the right-hand side thereof. In like manner, stacking panel covering 200 may be closed from the open condition shown in FIG. 29 by raising cord 210 on the left-hand side thereof. Stacking panel covering 200 differs from those discussed above in that each panel 202 slides in front of that to its left in FIG. 28, rather than behind. This is sometimes referred to as "reverse stacking" as it is the reverse of the more common approach taken when stacking the panels in a covering of this type, namely, having each panel slide behind that next to it.

At the upper left-hand corner of the stacking panel covering 200 of FIGS. 28 and 29 is a headrail portion 216 which may be oriented essentially perpendicular to that from which panels 202 are suspended. A section of rail 108 may also be used as headrail portion 216, and may be pivoted to swing outward from a folded to perpendicular position when the covering 200 is being opened. The purpose of headrail portion 216 will be made clear below.

Figure 30:
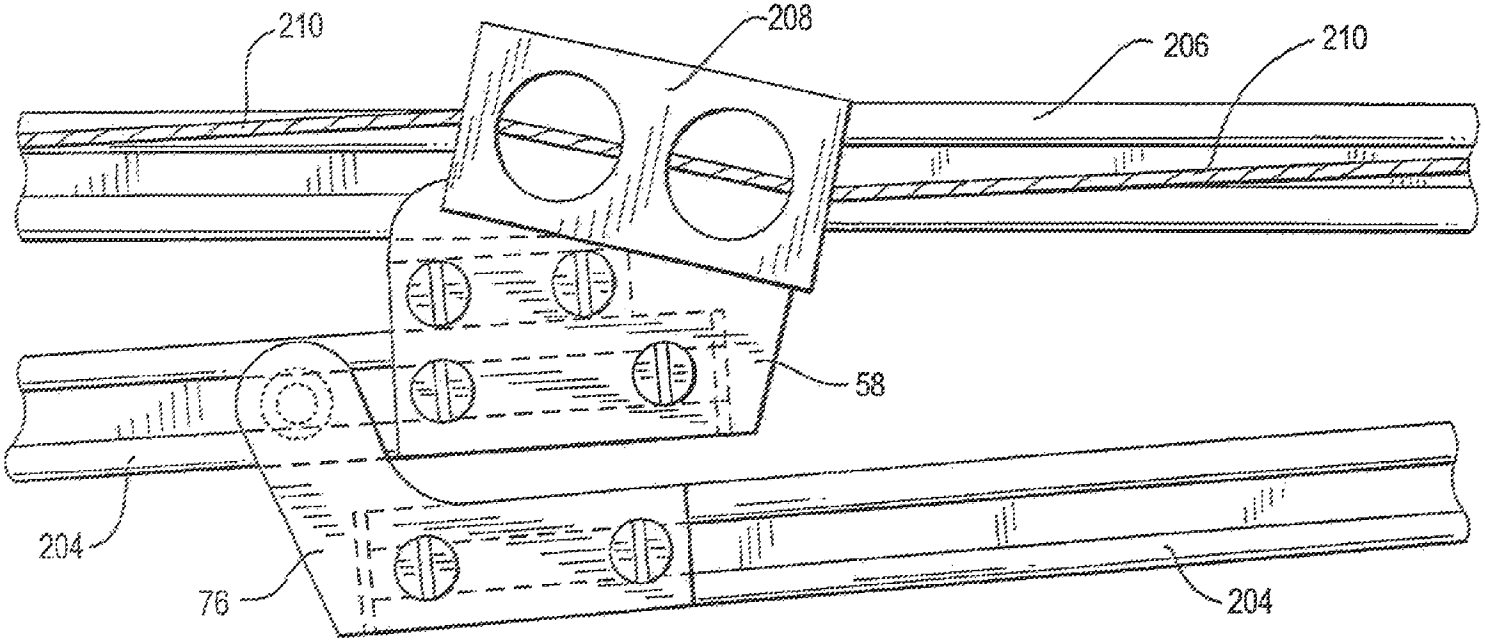
FIG. 30 is a plan view taken from above the headrail of the top of two adjacent panels when the stacking panel covering is closed a in FIG. 28.

FIG. 30 is a view taken from above headrail 206 of the top of two adjacent panels 202 when the stacking panel covering is closed as in FIG. 28. As discussed previously, particularly in connection with FIG. 12, one side of each panel 202 slides along headrail 206 using rail glide 58. The other side of each panel 202 is "piggybacked" on that to its left using piggyback glide 76. Driving block 208 is mounted on the rail glide 58 for each panel 202. Cord 210 is passed through driving block 208 through passages therein such that cord 210 makes an oblique angle within the driving block 208 with respect to the headrail 206. Because of fictional forces between the cord 210 and the passages through the driving block 208, cord 210 does not slide readily through driving block 208 when passing therethrough at an oblique angle as shown in FIG. 30. These frictional forces play an important part in opening the stacking panel covering 200 when it is closed as shown in FIG. 28.

Figure 31:
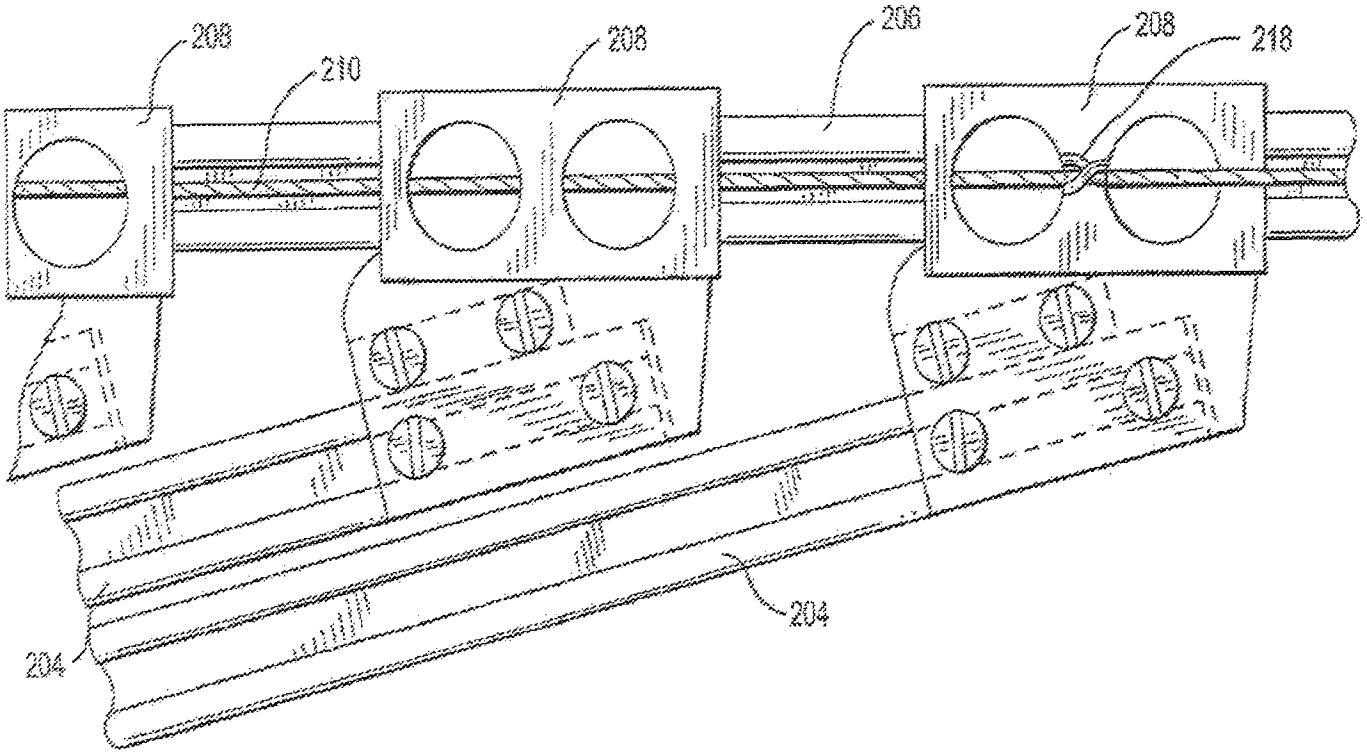
FIG. 31 is plan view taken from above the headrail of the top of the rightmost adjacent panels when the stacking panel covering is open as in FIG. 29.

FIG. 31 is a view taken from above headrail 206 of the top of the rightmost adjacent panels 202 when the stacking panel covering 200 is open as in FIG. 29. Cord 210 is tied to driving block 208 of the rightmost panel 202 at knot 218, but passes through driving blocks 208 of the remaining panels 202 in a direction parallel to that of the headrail 206. As such, cord 210 may readily slide through the passages through driving blocks 208 when passing therethrough in the parallel direction shown in FIG. 31. Such free and relatively unencumbered passage through driving blocks 208 plays an important part in closing the stacking panel covering 200 when it is open as shown in FIG. 29.

More specifically, viewing FIGS. 29 and 31 together, as the vertically hanging cord 210 on the left-hand side of FIG. 29 is raised, or that on the right-hand side is lowered, the knot 218 causes the cord 210 to pull the rightmost panel 202 toward the right in the two figures. The rightmost panel 202 moves in this manner until the piggyback glide 76 thereof reaches and abuts against the rail glide of the next panel 202 to its left, in the manner shown in FIG. 30. At that point, the rightmost panel 202 will pull the next panel 202 to the left toward the right. This process continues with each successive panel 202 pulling that to its left toward the right until the stacking panel covering 200 is closed as shown in FIG. 28. It will be observed, by comparing FIGS. 30 and 31, that as the stacking panel covering 200 is closed each panel 202 rotates through an oblique angle toward the headrail 206, thereby turning the driving blocks 208 from the orientation shown in FIG. 31 to that shown in FIG. 30.

Figure 32:
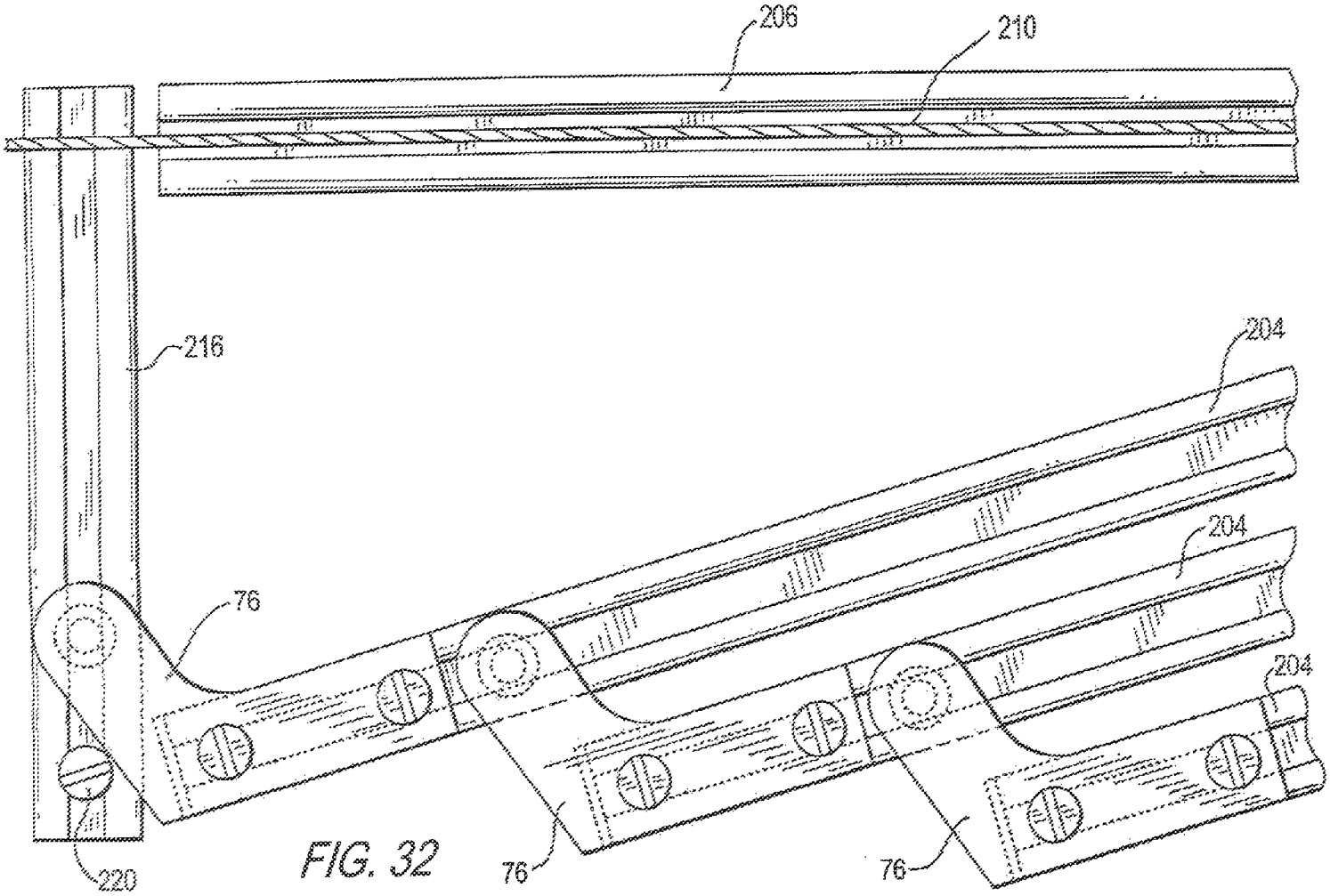
FIG. 32 is a plan view taken from above the headrail of the top of the leftmost adjacent panels when the stacking panel covering is open.

FIG. 32 is a view taken from above headrail 206 of the top of the leftmost adjacent panels 202 when the stacking panel covering is open as in FIG. 29. In this view, it may be seen that the headrail portion 216 enables the panels 202 to form a stack, such as that on the left-hand side of FIG. 29, when the stacking panel covering 200 is open without having the panels 202 bind against one another.

When the stacking panel covering 200 is closed, as in FIGS. 28 and 30, it may be opened by lowering the vertically hanging cord 210 on the left-hand side of FIG. 28, or by raising the vertically hanging cord 210 on the right-hand side. Initially, all panels 202 move toward the left when the cord 210 is manipulated in this manner. The rightmost panel 202 does so because the cord 210 is tied to driving block 208 of that panel 202 with knot 218, while the others do so because of frictional forces between the cord 210 and driving blocks 208, as discussed above with regard to FIG. 30. As panels 202 move toward the left, leftmost panel 202, which is piggybacked onto headrail portion 216, rotates away from headrail 206 as piggyback glide 76 moves outwardly along headrail portion 216 until it is stopped by screw 220. At that point, driving block 208 on rail glide 58 for leftmost panel 202 assumes the orientation of driving blocks 208 in FIG. 31, allowing cord 210 to slip through while still pulling the panels 202 to the right toward the left. This process continues as, one-by-one, each successive panel 202 slides in front of the one to its left until stopped by the piggyback glide 76 of the panel 202 to its left until the stacking panel covering is completely opened as in FIG. 29.

It is to be understood, finally, and is within the scope of the present invention, that a mirror image of stacking panel covering 200 can be made and will be described by switching the designations "right" and "left' in the preceding paragraphs. In practice, it has been observed that where an upper fabric rail in an embodiment of the present invention having curved panels is not precisely oriented, the panel may acquire an unsightly crosswise crease at some point along its hanging length. Essentially, this results when the curved upper fabric rail from which the panel is suspended is not perfectly horizontal, perhaps because the headrail or the upper fabric rail itself is not properly oriented. As a consequence, the curved panel, which, as stated at the outset, is cylindrically convex when viewed from the interior of a room in which the stacking panel covering is hung, is forced into an orientation not perpendicular to the floor. Depending on the strength or rigidity of the material from which the curved panel is made, it may not be able to maintain such an orientation without developing an unsightly crease running thereacross in response to gravitational forces pulling straight down upon it.

In another embodiment of the stacking panel covering of the present invention, this problem is addressed by suspending the curved panels from upper fabric rails in a manner that enables them to hang vertically regardless of any departure of the upper fabric rails from a horizontal orientation. This solution is based on a recognition that the center of gravity of a cylindrically convex panel is located at a point in space behind the back or concave side of the panel and more or less midway between the top and bottom thereof. Clearly, then, if the curved panel were suspended, in effect, from a point directly above the center of gravity, it would hang vertically.

Figure 33:
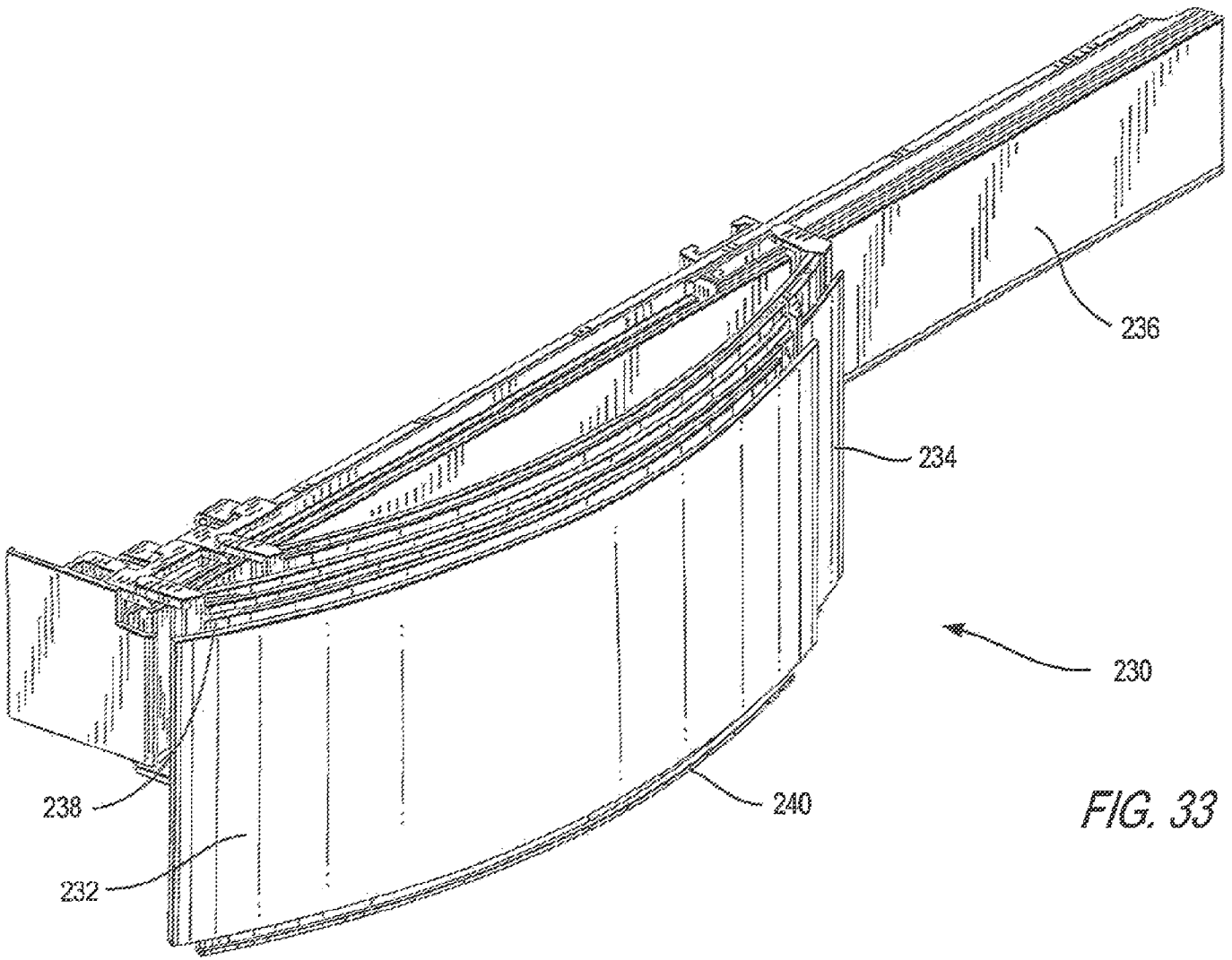
FIG. 33 is a perspective view of another embodiment of the stacking panel covering of the present invention when opened.

Referring now to FIG. 33, a perspective view of stacking panel covering 230, simplified to shown only two curved panels 232, 234, is shown. Panel 232 is fixed at the left-hand end of the headrail 236, while panel 234 may slide left or right to open or close the stacking panel covering 230, respectively. Panel 232 "piggybacks" on panel 234 in the manner previously described. Additional panels 234, each having its left upper corner slidable along headrail 236 and its right upper corner piggybacked on that next to it, in the manner previously described, could be inserted to produce a covering 230 having any number of panels 234. In any event, each panel 232, 234 has an upper fabric 238 and a lower fabric rail 240.

Figure 34:
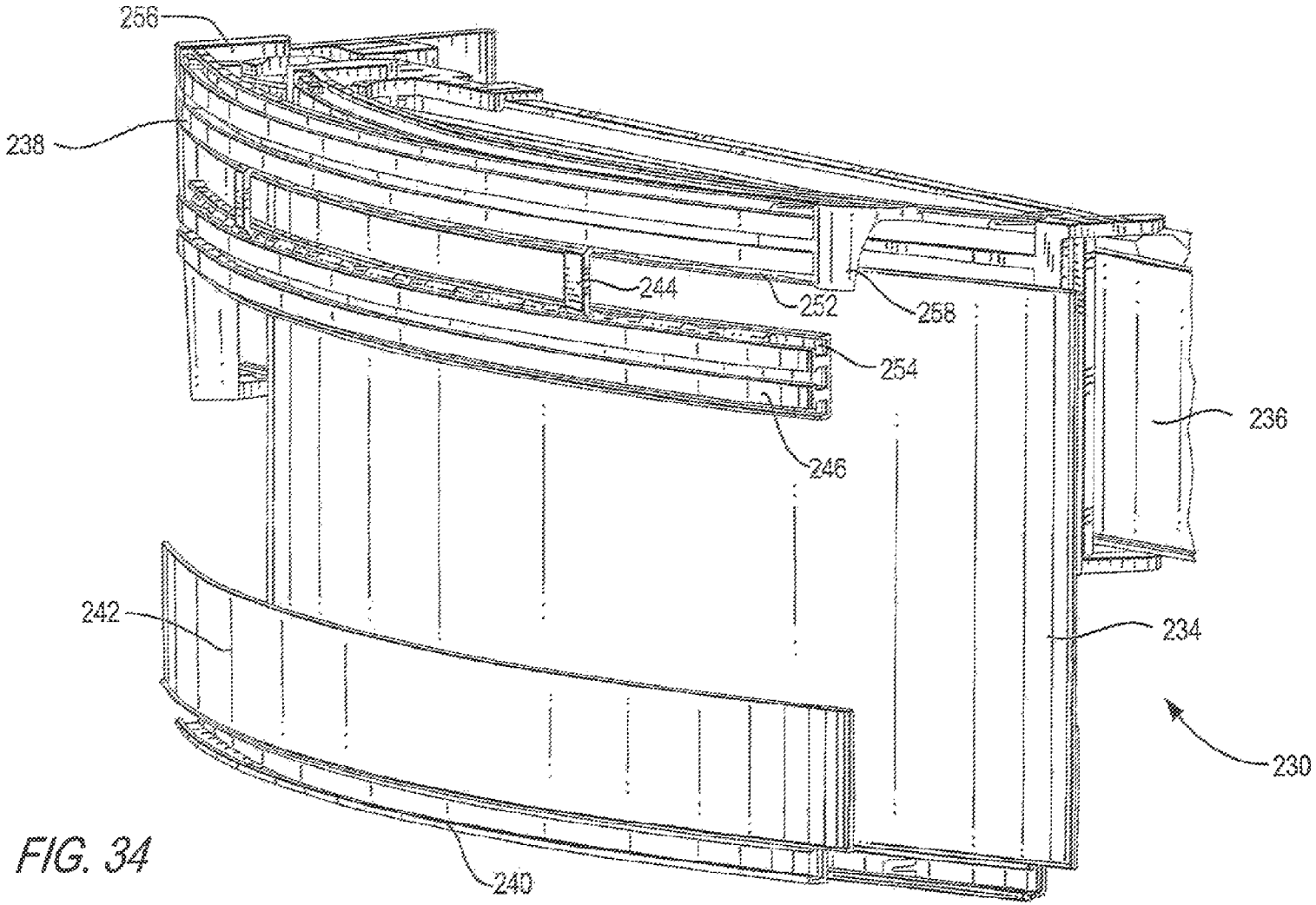
FIG. 34 is another perspective view of the embodiment shown in FIG. 33.

FIG. 34 is a perspective view, taken from a somewhat different direction from FIG. 33, of stacking panel covering 230 with panel 232 removed.

Lower fabric rail 240 is attached to a plastic (PVC) strip 242 to which the lower part of panel 232 is ordinarily attached using an adhesive. Upper fabric rail 238 is attached, by means of hinge 244, to a middle fabric rail 246 from which panel 232 is directly suspended. Hinge 244 permits middle fabric rail 246 to swivel relative to upper fabric rail 238, so that panel 232 may hang vertically regardless of any departure of upper fabric rail 238 from a horizontal orientation.

Figure 35:
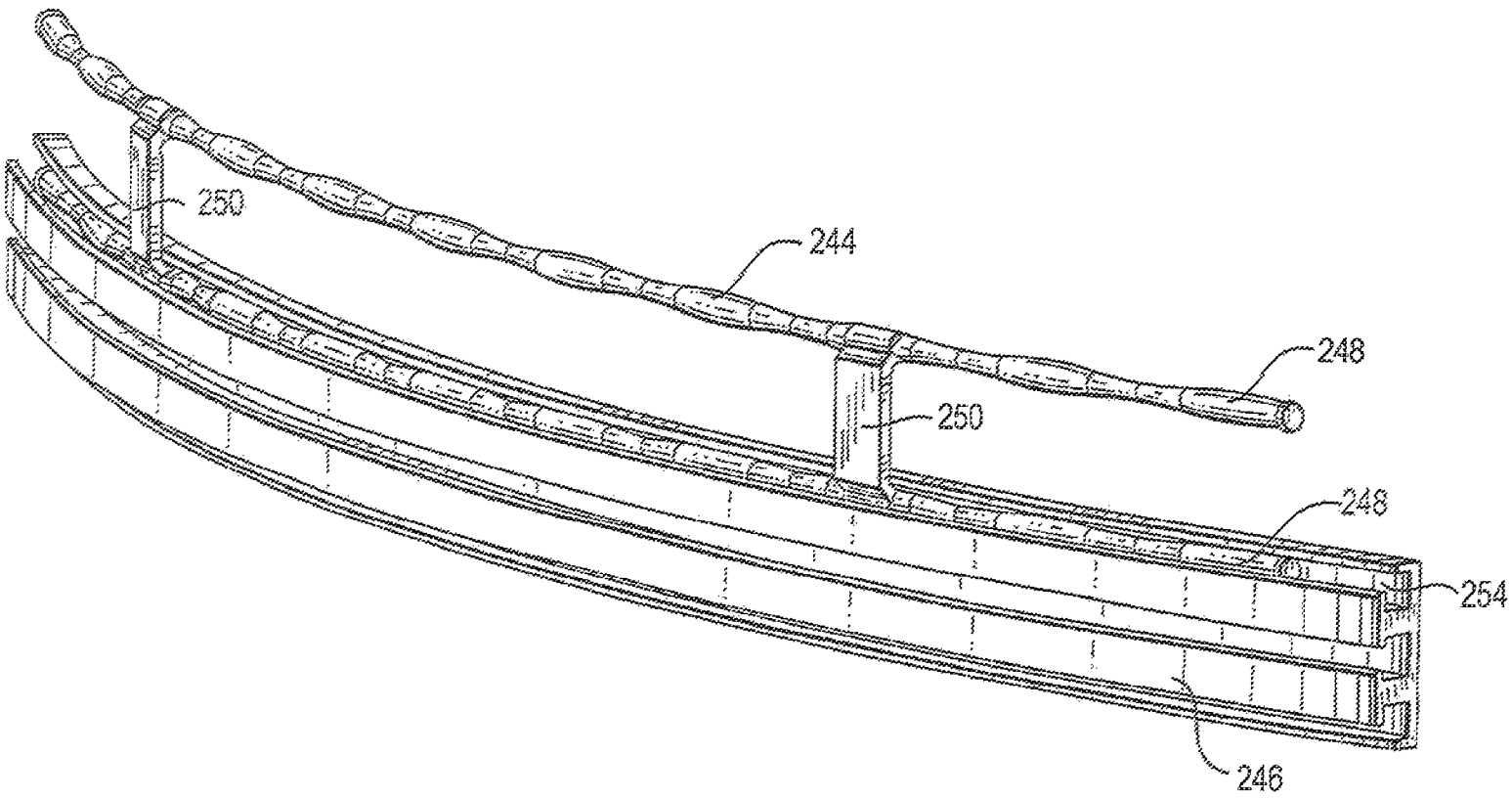
FIG. 35 is perspective view of a hinge and middle fabric rail used in the embodiment of FIG. 33.

FIG. 35 is a perspective view of the hinge 244 and middle fabric rail 246 taken from the vantage point of FIG. 34. Hinge 244 comprises two curved parallel rod-like members 248 joined by two bridges 250. The rod-like members 248, as may be observed, may vary in cross-sectional area along their lengths. This variation may be as illustrated in FIGS. 34 and 35, although it may alternatively have an appearance resembling a string of spherical beads attached one to the next by a thin connecting member. In any event, the hinge 244 is integrally molded from a polymeric resin material, that is, from a plastic. The thinner sections of the rod-like members 248, however they may be formed, enable them to twist about their lengthwise directions more readily, and ultimately enable the hinge to function in its intended manner.

It will be observed in FIGS. 34 and 35 that the rod-like members 248 are somewhat shorter than the middle-fabric rail 246 and upper fabric rail 238. Rod-like members 248 are disposed in channel 252 in upper fabric rail 238 and channel 254 in middle fabric rail 246, and are maintained in precise positions therein by end caps (not shown) in middle fabric rail 246 and by slider member 256 and piggyback member 258 in upper fabric rail 252.

Bridges 250 connect the two curved parallel rod-like members 248 to one another, and accordingly connect the upper fabric rail 238 and the middle fabric rail 246 together. The ability of the rod-like members 248 to twist allows the hinge 244 to function as such, and enables the middle fabric rail 246 to swivel relative to upper fabric rail 238. Bridges 250 are also equally spaced on either side of the center of the hinge 244 such that a line between them lies in a vertical plane which includes the center of gravity of the panel suspended from the middle fabric rail 246. As a consequence, the panel, suspended in effect by the bridges 250, will hang vertically despite any departure of the upper fabric rail 238 from a horizontal or level orientation.

Figure 36:
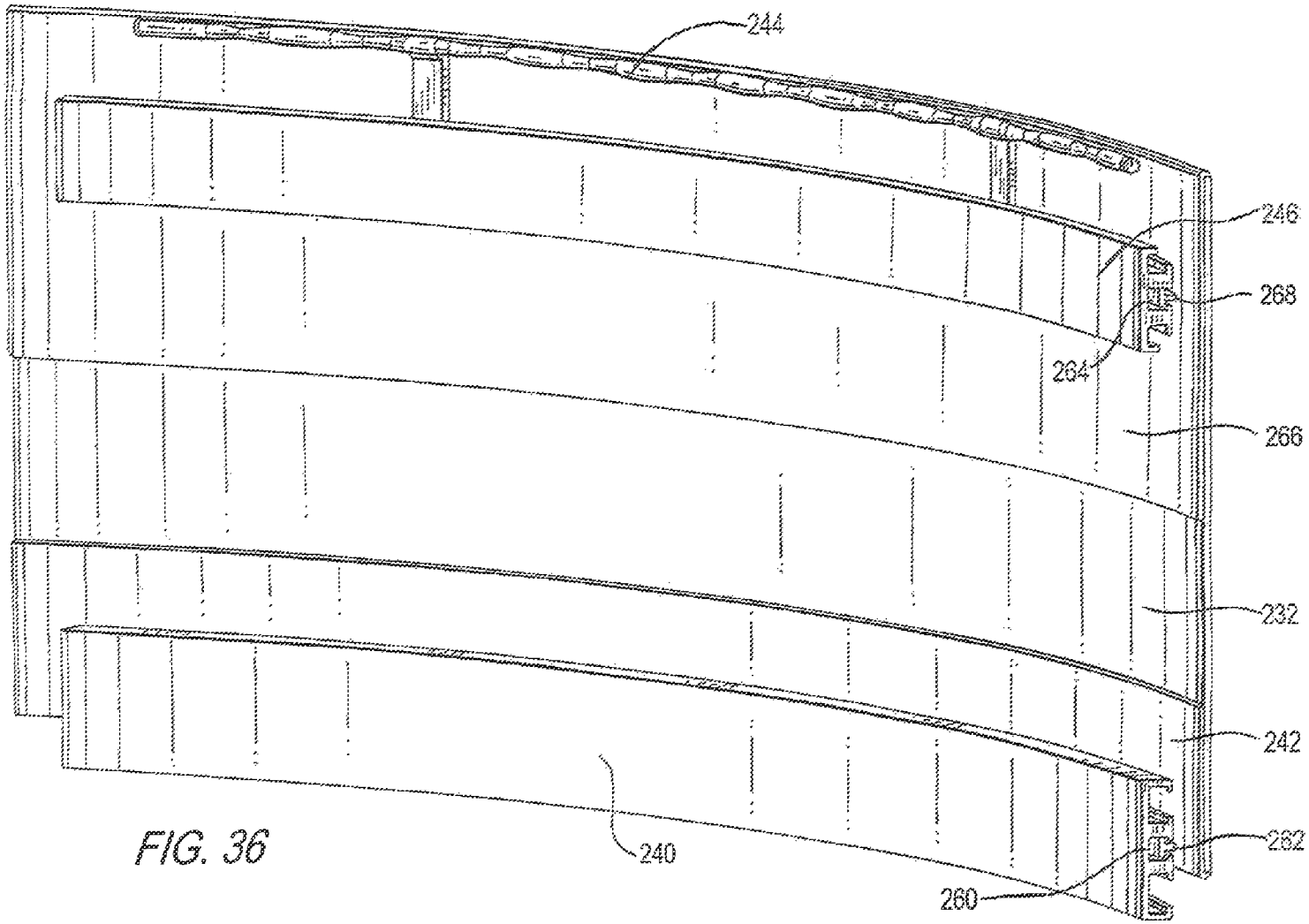
FIG. 36 is a perspective view of the rear side of a panel of the embodiment of FIG. 33.

FIG. 36 is a perspective view of the rear side of a panel 232 showing the manner in which it is connected to the middle fabric rail 246 and lower fabric rail 240. Panel 232, which for the purpose of illustration is much shorter than would actually be the case, is, as stated above, attached to plastic (PVC) strip 242 with an adhesive. Lower fabric rail 240 has a central channel 260, while plastic (PVC) strip 242 has a T-shaped coextrusion 262 for attaching the lower fabric rail 240 thereto by sliding T-shaped coextrusion 262 into central channel 260.

In a similar manner, middle fabric rail 246 has a central channel 264. The top of panel 232 is attached by an adhesive to plastic (PVC) strip 266 which also has a T-shaped coextrusion 268 for attaching the middle fabric rail 246 thereto by sliding T-shaped coextrusion 268 into central channel 264.

Modifications to the above would be obvious to those of ordinary skill in the art, but would not bring the invention so modified beyond the scope of the appended claims.

What is claimed is:

1. A stacking panel covering for an architectural opening, said stacking panel covering comprising:

a headrail configured to be mounted relative to the architectural opening, said headrail having a longitudinal direction, and a first end and a second end; and a plurality of panels provided in operative association with said headrail, each of said panels having a first upper corner and a second upper corner, said panels including a first panel positioned closest to said first end of said headrail, a second panel positioned closest to said second end of said headrail, and a plurality of intermediate panels positioned between said first and second panels;

wherein:

said first upper corner of said first panel is slidably attached to said headrail;

each of said first upper corner of said second panel and said first upper corners of said intermediate panels are slidably coupled to an adjacent panel positioned closer to said first end of said headrail such that said first upper corner of said second panel and said first upper corners of said intermediate panels are each vertically supported relative to said headrail by an adjacent panel;

said second upper corner of said first panel and said second upper corners of said intermediate panels are slidable in said longitudinal direction of said headrail;

said plurality of panels forms an overlapped stack at said second end of said headrail when said first panel is directed towards said second end to open said stacking panel covering; and said plurality of panels at least partially blocks the architectural opening when said first panel is moved towards said first end of said headrail.

2. A stacking panel covering as in claim 1, wherein said first upper corner of said second panel and said first upper corners of said intermediate panels are each spaced apart horizontally from said headrail.

3. A stacking panel covering as in claim 1, wherein said first upper corner of said second panel and said first upper corners of said intermediate panels are each slidable relative to said adjacent panel along a path spaced apart horizontally from said headrail.

4. A stacking panel covering as in claim 3, wherein said path is defined by a fabric rail coupled to said adjacent panel, said fabric rail being separate and apart from said headrail.

5. A stacking panel covering as in claim 1, wherein, when said plurality of panels forms said overlapped stack, said first upper corner of each of said intermediate panels is spaced apart from said headrail by a different distance than said first upper corners of said other intermediate panels.

6. A stacking panel covering as in claim 1, wherein said second upper corner of said first panel and said second upper corners of said intermediate panels are slidably coupled to said headrail.

7. A stacking panel covering as in claim 6, wherein said first upper corner of said second panel and said first upper corners of said intermediate panels are not vertically supported by said headrail.

8. A stacking panel covering as in claim 1, wherein, when said first panel is moved from said first end of said headrail towards said second end of said headrail, each of said plurality of panels rotates in a direction towards said headrail.

9. A stacking panel covering for an architectural opening, said stacking panel covering comprising:

a headrail configured to be mounted to relative to the architectural opening, said headrail having a first end and a second end and defining a common track extending in a longitudinal direction between said first and second ends; and a plurality of panels provided in operative association with said headrail, each of said panels having a first upper corner and a second upper corner, said panels including a first panel positioned closest to said first end of said headrail, a second panel positioned closest to said second end of said headrail, and a plurality of intermediate panels positioned between said first and second panels;

wherein:

said first upper corner of said first panel is slidably coupled to said common track of said headrail;

said second upper corner of said second panel is coupled to said headrail;

said second upper corner of said first panel and said second upper corners of said intermediate panels are slidably coupled to said common track of said headrail;

said plurality of panels forms an overlapped stack at said second end of said headrail when said first panel is directed toward said second end to open said stacking panel covering; and said plurality of panels at least partially blocks the architectural opening when said first panel is moved towards said first end of said headrail.

10. A stacking panel covering as in claim 9, wherein said first and second upper corners of said first panel, said second upper corner of said second panel, and said second upper corners of said intermediate panels are supported by said headrail at said common track.

11. A stacking panel covering as in claim 9, wherein each of said first upper corner of said second panel and said first upper corners of said intermediate panels is slidably coupled to said adjacent panel such that said first upper corner of said second panel and said first upper corners of said intermediate panels are each vertically supported relative to said headrail by said adjacent panel.

12. A stacking panel covering as in claim 9, wherein said first upper corner of said second panel and said first upper corners of said intermediate panels are each spaced apart horizontally from said headrail.

13. A stacking panel covering as in claim 9, wherein said first upper corner of said second panel and said first upper corners of said intermediate panels are each slidable relative to said adjacent panel along a path spaced apart horizontally from said headrail.

14. A stacking panel covering as in claim 9, wherein each of said first upper corner of said second panel and said first upper corners of said intermediate panels are slidably coupled to an adjacent panel closer to said first end of said headrail.

15. A stacking panel covering as in claim 9, wherein said second upper corner of said second panel is fixed at said second end.

16. A stacking panel covering for an architectural opening, said stacking panel covering comprising:

a headrail configured to be mounted relative to the architectural opening, said headrail having a longitudinal direction, and a first end and a second end; and a plurality of panels provided in operative association with said headrail, each of said panels having a first upper corner and a second upper corner, said panels including a first panel positioned closest to said first end of said headrail, a second panel positioned closest to said second end of said headrail, and a plurality of intermediate panels positioned between said first and second panels;

wherein:

said first upper corner of said first panel is slidably coupled to said headrail;

said first upper corner of said second panel and said first upper corners of said intermediate panels are slidably coupled to an adjacent panel closer to said first end of said headrail;

said second upper corner of said first panel and said second upper corners of said intermediate panels are slidably coupled to said headrail;

said plurality of panels forms an overlapped stack at said second end of said headrail when said first panel is directed toward said second end to open said stacking panel covering;

said plurality of panels at least partially blocks the architectural opening when said first panel is moved towards said first end of said headrail; and when said plurality of panels forms said overlapped stack, said first upper corner of each of said intermediate panels is spaced apart from said headrail by a different distance than said first upper corners of said other intermediate panels.

17. A stacking panel covering as in claim 16, wherein said distance is measured transverse to said longitudinal direction of said headrail.

18. A stacking panel covering as in claim 16, wherein each of said first upper corner of said second panel and said first upper corners of said intermediate panels is slidably coupled to said adjacent panel such that said first upper corner of said second panel and said first upper corners of said intermediate panels are each vertically supported relative to said headrail by said adjacent panel.

19. A stacking panel covering as in claim 16, wherein said first upper corner of said second panel and said first upper corners of said intermediate panels are each slidable relative to said adjacent panel along a path spaced apart horizontally from said headrail.

20. A stacking panel covering as in claim 16, wherein said second upper corner of said second panel is fixed at said second end of said headrail.

21. A stacking panel covering as in claim 16, wherein, when said plurality of panels forms said overlapped stack, said first upper corner of each of said intermediate panels is spaced apart from said headrail by a different horizontal distance than said first upper corners of said other intermediate panels.

22. A stacking panel covering as in claim 16, wherein each of said plurality of panels defines a curved profile in a direction extending parallel to the longitudinal direction of said headrail.

* * * * *